US012072097B2

(12) United States Patent
Kraus et al.

(10) Patent No.: US 12,072,097 B2
(45) Date of Patent: Aug. 27, 2024

(54) ACTIVE AND PASSIVE COMBUSTION STABILIZATION FOR BURNERS FOR HIGHLY AND RAPIDLY VARYING FUEL GAS COMPOSITIONS

(71) Applicant: Honeywell International Inc., Charlotte, NC (US)

(72) Inventors: Kurt Kraus, Tulsa, OK (US); Stefano Bietto, Tulsa, OK (US)

(73) Assignee: Honeywell International Inc., Charlotte, NC (US)

( * ) Notice: Subject to any disclaimer, the term of this patent is extended or adjusted under 35 U.S.C. 154(b) by 190 days.

(21) Appl. No.: 17/451,932

(22) Filed: Oct. 22, 2021

(65) Prior Publication Data

US 2022/0307689 A1 Sep. 29, 2022

Related U.S. Application Data

(60) Provisional application No. 63/167,286, filed on Mar. 29, 2021.

(51) Int. Cl.

| | |
|---|---|
| ***F23N 1/00*** | (2006.01) |
| ***F23D 14/22*** | (2006.01) |
| ***F23D 14/48*** | (2006.01) |

(52) U.S. Cl.

CPC ..... *F23N 1/002* (2013.01); *F23D 14/22* (2013.01); *F23D 14/48* (2013.01);

(Continued)

(58) Field of Classification Search

CPC ..... F23N 1/002; F23N 2235/16; F23D 14/22; F23D 14/48

(Continued)

(56) References Cited

U.S. PATENT DOCUMENTS

| | | | |
|---|---|---|---|
| 4,772,420 | A | 9/1988 | Pinto et al. |
| 6,499,990 | B1 | 12/2002 | Zink et al. |

(Continued)

FOREIGN PATENT DOCUMENTS

| | | | |
|---|---|---|---|
| CN | 210740397 | U | 6/2020 |
| CN | 111928240 | A | 11/2020 |
| EP | 0772001 | A1 | 5/1997 |

OTHER PUBLICATIONS

Energy API, API Recommended Practice 535, Third Edition, May 2014, Burners for Fired Heaters in General Refinery Service (Abstract and Table of Contents only).

(Continued)

*Primary Examiner* — Vivek K Shirsat

(57) ABSTRACT

A burner apparatus and process are described. The burner apparatus includes an inlet chamber in communication with a combustion chamber. A primary conduit delivers fuel gas to the combustion chamber. Each of a plurality of primary tips is located in the throat of the burner tile. Each of a plurality of cavities is disposed on a downstream wall of the burner tile and stabilize the flame. The primary tips have an end port and a lateral port. A secondary conduit provides fuel gas to a plurality of secondary tips. In a passive control mode, the fuel gas to the primary tips and secondary tips is a mixed gas comprising flue gas and fuel gas. In an active mode, valves are provided to proportion the amount of fuel gas fed to the primary tips and the amount of flue gas provided to the secondary tips.

17 Claims, 15 Drawing Sheets

(52) U.S. Cl.
CPC ..... *F23D 2209/20* (2013.01); *F23D 2900/14002* (2013.01); *F23K 2900/05004* (2013.01); *F23N 2235/16* (2020.01); *F23N 2235/24* (2020.01)

(58) Field of Classification Search
USPC ..... 431/354–355, 12
See application file for complete search history.

(56) References Cited

U.S. PATENT DOCUMENTS

| | | | | |
|---|---|---|---|---|
| 7,950,919 | B2 | 5/2011 | Johnson et al. | |
| 2007/0292811 | A1* | 12/2007 | Poe | F23M 5/025 431/278 |
| 2016/0250580 | A1 | 9/2016 | Monereau et al. | |
| 2017/0159938 | A1 | 6/2017 | Barnhart et al. | |
| 2019/0093881 | A1 | 3/2019 | Risseeuw et al. | |
| 2019/0135626 | A1 | 5/2019 | Rafati et al. | |
| 2020/0386404 | A1 | 12/2020 | Kraus et al. | |
| 2022/0042706 | A1* | 2/2022 | Farley | G01K 3/005 |

OTHER PUBLICATIONS

International Preliminary Report on Patentability from corresponding PCT application No. PCT/US2022/071387, issued on Oct. 3, 2023.
International Search Report from corresponding PCT application No. PCT/US2022/071387, mailed on Jul. 21, 2022.
Written Opinion from corresponding PCT application No. PCT/US2022/071387, mailed on Jul. 21, 2022.

* cited by examiner

ACTIVE AND PASSIVE COMBUSTION STABILIZATION FOR BURNERS FOR HIGHLY AND RAPIDLY VARYING FUEL GAS COMPOSITIONS

RELATED APPLICATIONS

This application claims priority to U.S. Provisional Patent Application Ser. No. 63/167,286 filed on Mar. 29, 2021, the entirety of which is incorporated herein by reference.

FIELD OF THE DISCLOSURE

This disclosure relates generally to features of mixed fuel gas burners, and more particularly to burners with cavities that allow stable burning with wide-ranging fuel gas compositions used in a passive or active burner control system, as well as a method of operating such burners.

BACKGROUND OF THE DISCLOSURE

Waste gas burner systems are used to combust low BTU mixed gas streams produced by various processes in chemical processing facilities. Such processes include furnaces having many burners which combust fuel to produce heat. It is important to achieve efficient and stable combustion of mixed gas streams having varying contents while minimizing use of high BTU fuel gases.

Increased regulation of gas streams exhausted to the atmosphere can be expected in the future. Furthermore, current and future carbon dioxide ($CO_2$) removal technology for natural gas streams result in waste gas streams varying fuel contents. Process heater and furnaces for low carbon and carbon capture processes must accommodate and operate seamlessly with highly and rapidly varying fuel gases. For example, the fuel gas compositions may range widely and rapidly from say 100% methane to 100% hydrogen or 100% natural gas to 100% PSA purge gas, with or without the $CO_2$ in the purge gas. And the available fuel pressures may vary from as low as 1 or 2 to around 30 psig (0.07 to 2.07 barg).

Operating companies require that the furnaces, heaters, and their burners operate continuously, stably, efficiently and with low NOx emissions regardless of the fuel gas available. Current burners cannot accommodate highly variable fuels as may be required for low carbon or carbon sequestration operations and the present disclosure facilitates these highly variable fuel gases.

Therefore, there is a need for burner systems that can be operated and integrated with existing separation systems. There is also a need for burner systems designed to increase burner stability over a wide range of operating conditions and thereby minimize the production of NOx.

SUMMARY

The present invention provides a burner comprising: a plenum; a burner tile configured to provide combustion air from the plenum through the burner tile to a combustion zone, the burner tile having an upstream portion, a throat, and a downstream portion, the downstream portion having a wall and a plurality of cavities disposed on the wall; and at least one primary conduit having a plurality of primary tips configured to inject a fuel stream comprising fuel gas into the combustion zone, wherein each of the primary tips comprising a plurality of ports.

A second aspect of the invention is a burner comprising: a plenum; a burner tile arranged such that combustion air from the plenum flows from the plenum through the burner tile to a combustion zone, the burner tile having an upstream portion, a throat, and a downstream portion, the downstream portion having wall, and the burner tile further comprising a plurality of cavities disposed on the wall; at least one primary conduit having a plurality of primary tips configured to inject a fuel stream comprising fuel gas into the combustion zone; at least one secondary conduit having a plurality of secondary tips configured to inject a second fuel stream; at least one sensor configured to sense one or more aspects of the combustion zone; a valve in fluid communication with the primary conduit and the secondary conduit; and a controller that receives inputs from the at least one sensor, wherein the controller is configured to operate the valve to control the one or more aspects of the combustion zone.

A third aspect of the invention is a process of operating a burner, the process comprising: injecting combustion air into a combustion zone associated with a burner tile, the burner tile having an upstream portion, a throat, and a downstream portion, the downstream portion having a wall, the burner tile further comprising a plurality of cavities disposed on the wall; and injecting a first portion of fuel gas through a plurality of primary tips into the combustion zone, wherein the combustion air and the first portion of fuel gas produce a flame in the combustion zone.

A fourth aspect of the invention is a process of controlling a burner, the process comprising: injecting combustion air into a combustion zone associated with a burner tile, the burner tile having an upstream portion, a throat, and a downstream portion, the downstream portion having a wall, the burner tile further comprising a plurality of cavities disposed on the wall; injecting a first portion of fuel gas from primary conduit through a plurality of primary tips and into the combustion zone, wherein the first portion of fuel gas and the combustion air produce a flame in the combustion zone; injecting a second portion of fuel gas from a secondary conduit through a plurality of secondary tips; detecting one or more aspects of the combustion zone; and controlling a proportion of the first portion of fuel gas in relation to the second portion of fuel gas using a valve in fluid communication with the primary conduit and the secondary conduit.

Additional aspects, embodiments, and details of the invention, all of which may be combinable in any manner, are set forth in the following detailed description of the invention.

DETAILED DESCRIPTION OF THE DRAWINGS

One or more exemplary embodiments of the present disclosure will be described below in conjunction with the following drawing figures.

DETAILED DESCRIPTION OF THE INVENTION

As mentioned above, the burner system of the instant disclosure includes a plurality of cavities for burner flame stabilization.

With these general principles in mind, one or more embodiments of the present invention will be described with the understanding that the following description is not intended to be limiting.

Stabilization cavities may be used as flameholders in supersonic combustors and, to a lesser extent, in sub-sonic burners due to their outstanding potential to stabilize combustion without excessive total pressure loss. Stabilization cavities create an environment for the establishment of a stable, continuously operational flame front over a reasonable operating range for a given set of combustion operating conditions. Operating conditions can vary, and the variabilities can include the composition, available pressure, and heating value for the fuel gas. Additionally, the oxygen content, temperature, pressure of the combustion air or oxidant can vary. As examples, the fuel gas composition can vary from being composed of 0% to 100% methane by volume, 0% to 100% hydrogen, 0% to 100% C02 or N2, 0% to 100% Propane and so on, with the balance being made up of various combustible and noncombustible gases. Further, the fuel pressure available to the burner may vary from near zero to over 100 psig (0 to 6.9 barg). Meanwhile, the air pressure available to the burner may vary from near zero to over 100 psig (0 to 6.9 barg). And the change in variables may occur in a matter for a few seconds. The oxygen content of the combustion air or oxidant may vary from 100% oxygen to less than 5% by volume and the temperature may vary from −50 to 1,200° F. (−45.5 to 649° C.).

Figure 1:
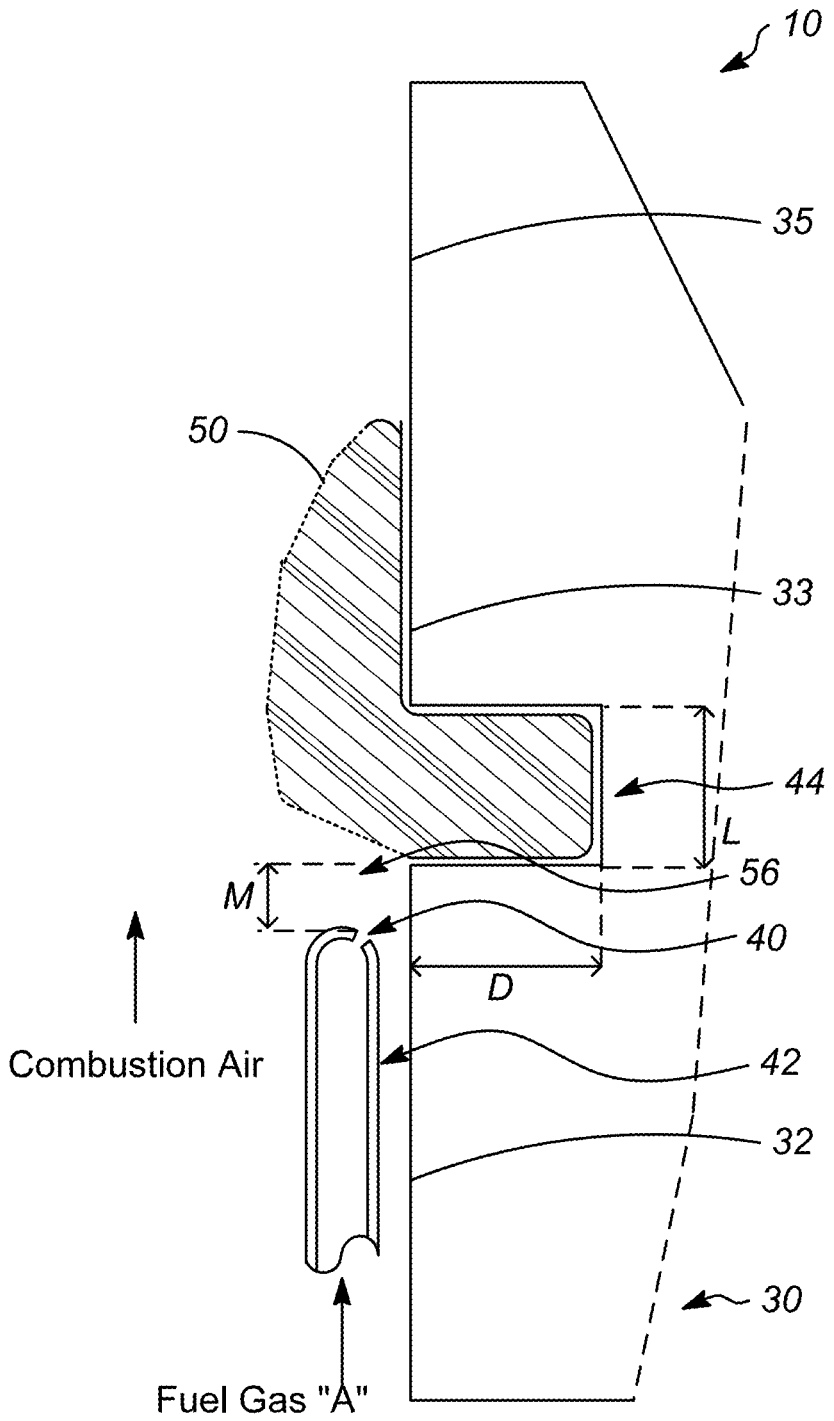
FIG. 1 shows a detailed sectional view of a burner system.

Burners that utilize cavities for stabilization are usually optimized for a relatively narrow variability of operating conditions, for example 100% natural gas (nearly 100% methane, say FUEL GAS "A", FIG. 1) may be made available to the burner at approximately 1 to 20 psig (0.07 to 1.38 barg) at ambient atmospheric air conditions, 21% oxygen at a temperature of −20 to 120° F. (−29 to 49° C.) with about 1.27 cm (0.5 inches) W.C. above atmospheric pressure available. A detailed view of a burner 10 having a burner tile 30 having a single cavity 44 is depicted in FIG. 1. The cavity 44 has dimensions L×D and is positioned M distance downstream of the fuel gas injection port 40 and into the combustion air stream may be optimized for establishing (igniting) and maintaining (burning) a stable flame front 50 over the range of operating conditions. The burner system 10 has a burner tile 30 has an upstream wall 32 and a downstream wall 33 on either side of the cavity 40. The fuel tip 42 has a fuel gas injection port 40 near a distal end in a combustion zone 56.

Figure 2:
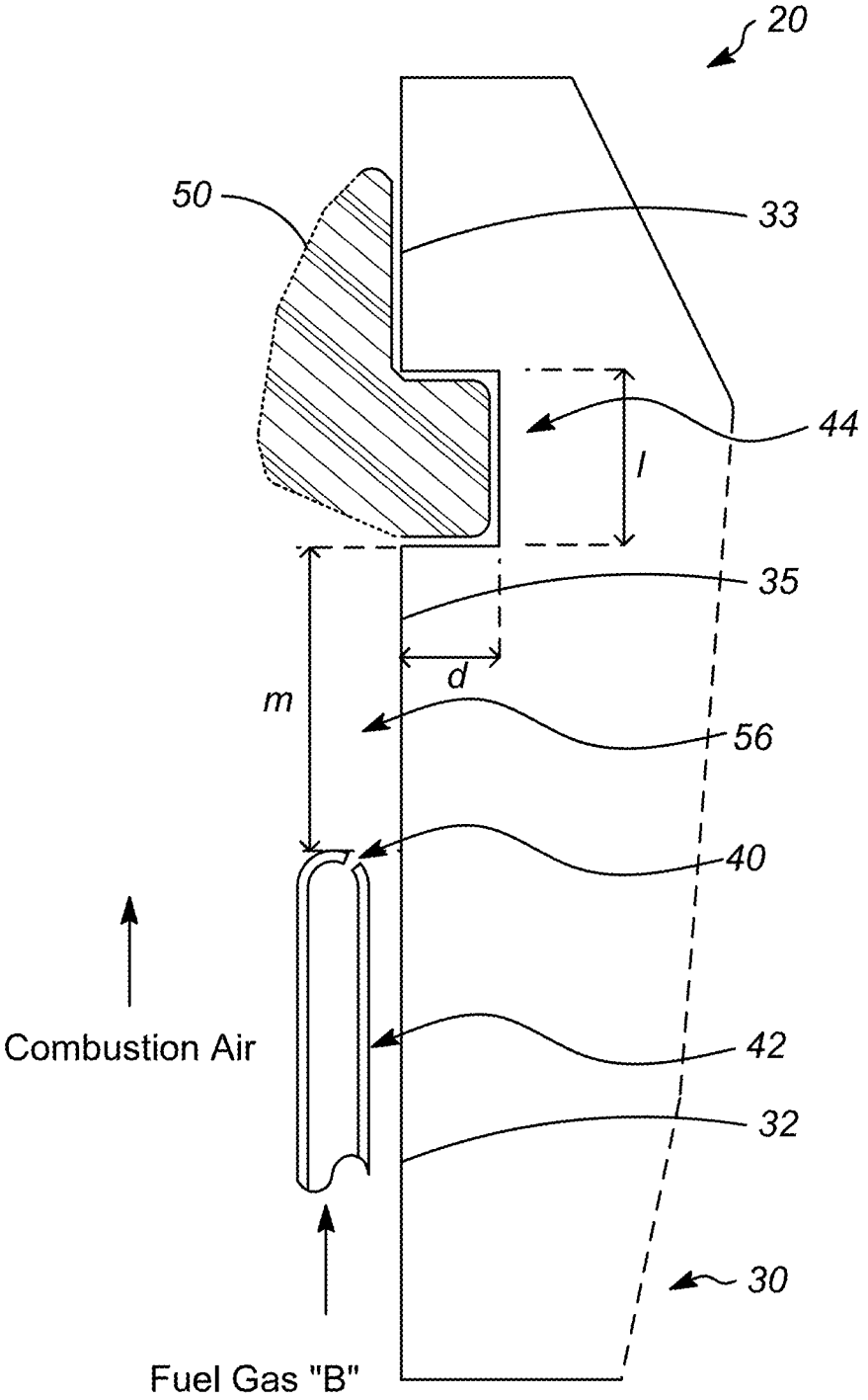
FIG. 2 shows a detailed sectional view of a further burner system.

In another case, say the case of a burner that combusts Pressure Swing Absorber (PSA) off gas, the fuel may be composed of 20% to 25% hydrogen, 10% to 15% methane, 40% to 60% $CO_2$ with the balance made up of other combustible and noncombustible gases and available to the same natural gas burner described above but available at pressures of less than 3 to nearly zero psig (0.21 to 0 barg) (FIG. 2, FUEL GAS "B"). This alternate fuel may constitute 0% to 100% of the burners heat input, firing duty.

It has been discovered that control of the NOx production may be achieved by providing an NOx reducing medium, such as PSA tail gas. NOx reducing fluids may include but may not be limited to flue gas from the combustion chamber, flue gas from the exhaust of the heater, boiler of furnace, steam (water vapor), nitrogen, carbon dioxide or even fuel gas such as methane. It is known that inert gases such as water vapor, nitrogen and carbon dioxide injected in the fuel gas or air stream of a burner can help reduce NOx emissions by reducing the partial pressure of reactants, both fuel and air, cooling and by transferring heat out of the combustion section of the combustion zones. Further, water vapor and flue gas containing water vapor facilitate the Water Gas Shift Reaction (WGSR) mechanisms of catalyzing and solvating the combustion reactions. Accordingly, in the various configurations of the present disclosure, a portion or all the NOx reducing medium is passed through the ports of primary and/or the secondary tips to facilitate selective and designed proportioning of the NOx reducing medium in the optimal location(s) to stabilize the flame 150 in the combustion zone(s). See FIG. 3.

The burner system 20 of FIG. 2 has a burner tile with a flat, continuous surface in the upstream wall 32, intermediate wall 35, and a downstream wall 33. A cavity 44 is provided in a downstream location in relation to the cavity of FIG. 1. For the case of firing 100% PSA off gas, a cavity 44 as depicted in FIG. 2 of dimensions 1×d positioned m distance downstream of the fuel gas injection point and into the combustion air stream may be optimized for establishing (igniting) and maintaining (burning) a stable flame front 50 over the range of operating conditions.

In most existent dual fuel burner designs, the burners designed to operate on both natural gas and PSA off gas, some proportion of natural gas (assist gas) must always be present to provide a stable flame front which is then utilized to stabilize the subsequently injected PSA off gas. The cavity for stabilizing 100% firing of PSA off gas in all conditions from light off to normal operation simply do not exist.

In some cases, refinery fuel gas, fuel gas synthesized as part of the refinery fuel gas RFG will be used in place of natural gas as the assist gas. In these cases, the cavities of FIG. 1 can be optimized for RFG service.

Figure 3:
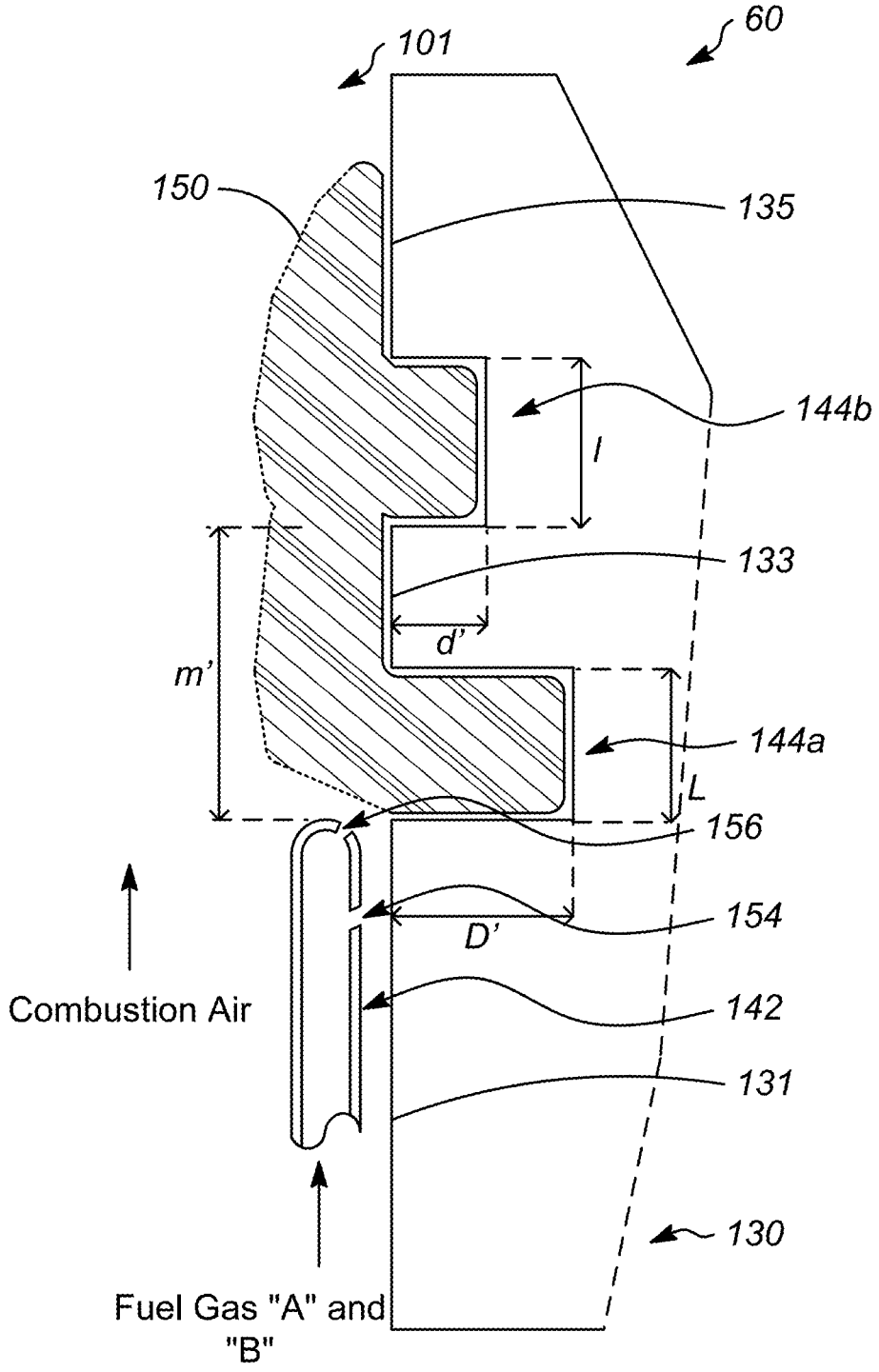
FIG. 3 shows a detailed sectional view of an embodiment of the present burner system.

The configuration as depicted in FIG. 3 comprises a burner system 60 having a plurality of cavities 144*a*-144*b* proximate to the combustion zone 101. Any proportion of either separately or combined fuel streams can be injected at a multiplicity of injection locations and a plurality of distances (m, M, m') from the cavities of a plurality of cavity geometries (D×L' or d×l'). For optimal performance, the geometries are modified and further optimized from the single fuel optimal dimension of m, M, d, D, l, or L to m', M', d', D', l' or L'. In doing so, the burner can operate continuously and stably, liberating the designed and process demanded heat (fuel gas flow rate) at the design efficient excess air level (efficiency) and at required flue gas exhaust emissions of say Nitric Oxide (NOx) formation without interruption or instability in the combustion process or the petrochemical or refining process of the heater or furnace as the fuel varies from 100% natural gas to 100% PSA off gas.

In the passive case, the tip 142 of the burner system 60 is one set of manifolded fuel gas delivery pipes used to inject either or both fuels are premixed as depicted in FIG. 3. In the illustrated embodiment, fuel gas A comprising assist gas (methane) and fuel gas B, which is as PSA tail gas that comprises NOx reducing medium (such as $CO_2$) are premixed. In the passive case, no information regarding the fuel composition or quality is needed to maintain the stable flame front regardless of the proportion of whichever fuel gas is being delivered to the burner. In the passive case, the burner responds instantaneously to the changes in fuel gas flow rates and compositions.

The burner tile 130 has an illustrated in FIG. 3 has substantially flat inner wall having a first portion 131 proximate to the tip 142, a first cavity 144*a*, an intermediate portion 133, a second cavity 144*b*, and a downstream portion 135. The first cavity has a depth of D' and a length L with substantially flat sidewalls and rounded corners. In the illustrated embodiment, the stable flame front 150 spans the first cavity and the second cavity 144*b*.

The tip 142, which may be a primary tip or secondary tip comprises a lateral port 154 and an end port 156. The lateral port 154 is disposed on a side of the primary tip and is angled toward the first portion 131 of the inner wall of the burner tile 130. The end port 156 is also angled toward the inner wall of the burner tile 130.

If the tip 142 is a secondary tip (see FIG. 4), the lateral port disposed on a side of the secondary tip and is angled toward an outer wall 160 of the burner tile 130, and the end port of disposed at a distal end of the secondary tip is also angled toward the outer wall of the burner tile.

In the active case, the burner system uses separately piped and valved injection jets as separately depicted in FIGS. 1 and 2. In this active case, information regarding the composition and flow rate of the fuel gas being delivered to the burner may be used to determine which injector location(s) are utilized at any moment in time. In the active case, the condition and state of the flame front is sensed with either AI enabled cameras or high-speed pressure sensors to assist in deciding via computer logic which injection locations may be used at any moment in time. See FIGS. 9C-9F.

In the illustrated embodiments, the fuel gas tips 142 number from 3 to 24, however, the fuel gas injectors can range in number from one to 100. The cavities 144 may be of highly variable shape and may have curved and undulating surfaces. This effectively means, that to accommodate widely ranging and highly variable fuel gas compositions and pressures, the cavities may be of unlimited shape and effective quantities. The cavities may be applied to flat surfaces, flat flame burners, of lengths ranging in length from one inch to ten feet in length. The cavities may also be applied to round burners of internal diameters from one inch to ten feet or more. The cavities may be internal to the burner in the air flow stream or may be external to the burner.

Flue gas or other inerting gas medium as may be one of the multiplicity of gases delivered in the manner of a fuel gas, either premixed and manifolded with or injected separately in manners depicted in FIGS. 1, 2 and 3 for the purposes of NOx mitigation or flame temperature control.

Features of this burner system may be applied to a burner's primary, secondary, or tertiary fuel gas injection locations.

Though a dual fuel arrangement has been described, this in no means shall be limiting and a multiplicity of fuel gases with highly variable fuel compositions, pressures and qualities may be delivered to the burner using this invention including but not limited to PSA purge gas where the $CO_2$ has been removed (possibly for $CO_2$ sequestration) and where the fuel gas composition ranges from approximately 40% to 70% methane and 5% to 30% hydrogen or CO content, the balance being made up of other combustible and noncombustible gases.

Further, the burner system is specifically well suited for applications where the fuel gas may vary from 100% natural gas (mostly methane) or Liquid Petroleum Gas (LPG) to 100% hydrogen firing.

In the more general cases, the burner system of the instant disclosure may be used on burner designed to accept an unlimited multiplicity of fuel gases and combustion air compositions.

Combustion air may be turbine exhaust gas of 5% to 25% oxygen at 500 to 1,500° F. (260 to 816° C.).

In the illustrated embodiment, the variables M, m, L, l, D, and are distances on the order of 0.64 to 61 cm (¼ to 24 inches).

While this invention describes in detail the nature of cavity stabilization, the ideas can also be extended to another common form of combustion stabilization referred to in the literature as bluff body stabilization. Discussions related to the arrangement and specific geometry of cavity stabilized combustion devices, burners, can be extended to and adapted to describe bluff body stabilized burners and burners with a combination of bluff body and cavity stabilization, which includes the majority of all low pressure drop, subsonic burners.

Figure 4:
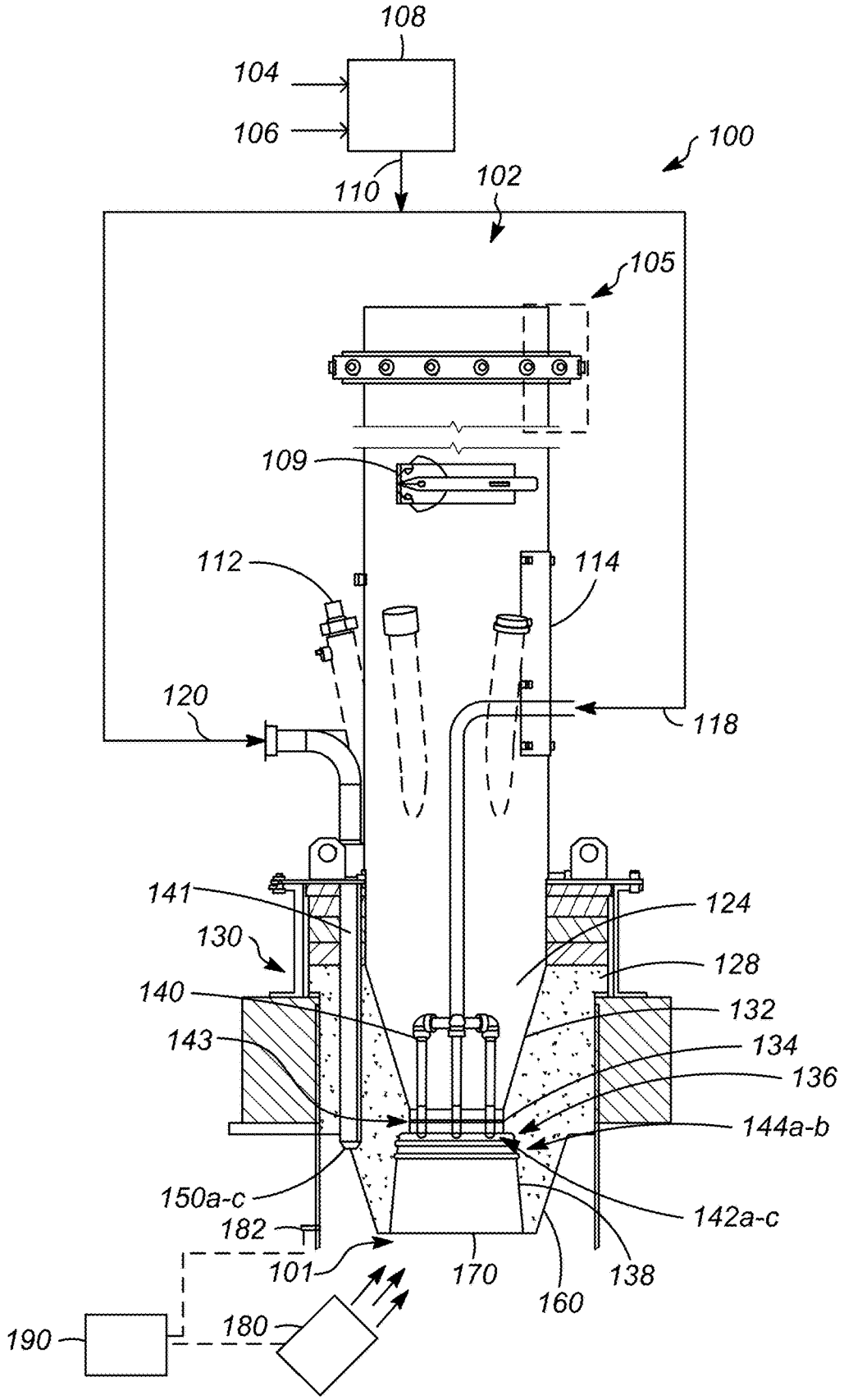
FIG. 4 shows sectional view of an embodiment of the present burner system.

As shown in FIG. 4, a burner system 100 of the present disclosure includes an air inlet portion 102 and an upstream body 105. An inlet damper 109 is provided to regulate air inlet flow. A plurality of nozzles 112 are provided to monitor the burner from the upstream end of the burner tile 130. An access port 114 is provided for accessing the upstream portion of the burner.

A plenum chamber 124 is provided upstream of the burner tile. The burner tile 130 is made of a refractory material 128 and has an upstream wall 132 in an upstream zone, a throat 134, an inner wall downstream of the throat 134, and an outer wall downstream of the throat 134. In the illustrated embodiment, the inner wall 138 and the outer wall 160 converge toward the burner tile outlet 170.

A first fuel gas 104 and a second fuel gas 106, which may be methane and PSA tail gas, respectively, are mixed in a mixing device 108 to provide a mixed fuel gas 110. A first portion 118 of the mixed fuel gas 110 flows through a primary conduit 140 having a plurality of fuel gas tips 142*a*-142*c*. A bluff body 143 mounting bracket is provided proximate to the throat 134 of the burner tile. A second portion 120 of the mixed fuel gas 110 flows through the secondary conduit 141 having a plurality of secondary tips 150*a*-150*c*.

A sensor 180, which can be a camera is provided downstream of the burner tile outlet 170 and is directed at the combustion zone 101. The one or more sensors 180, 182 are used to detect one or more parameters of the flame to determine and control flame stability. A controller 190 having a microprocessor is in communication with the sensors 180 and 182. Control of the fuel gas flows is further described herein in connection with the Active mode.

Figure 5:
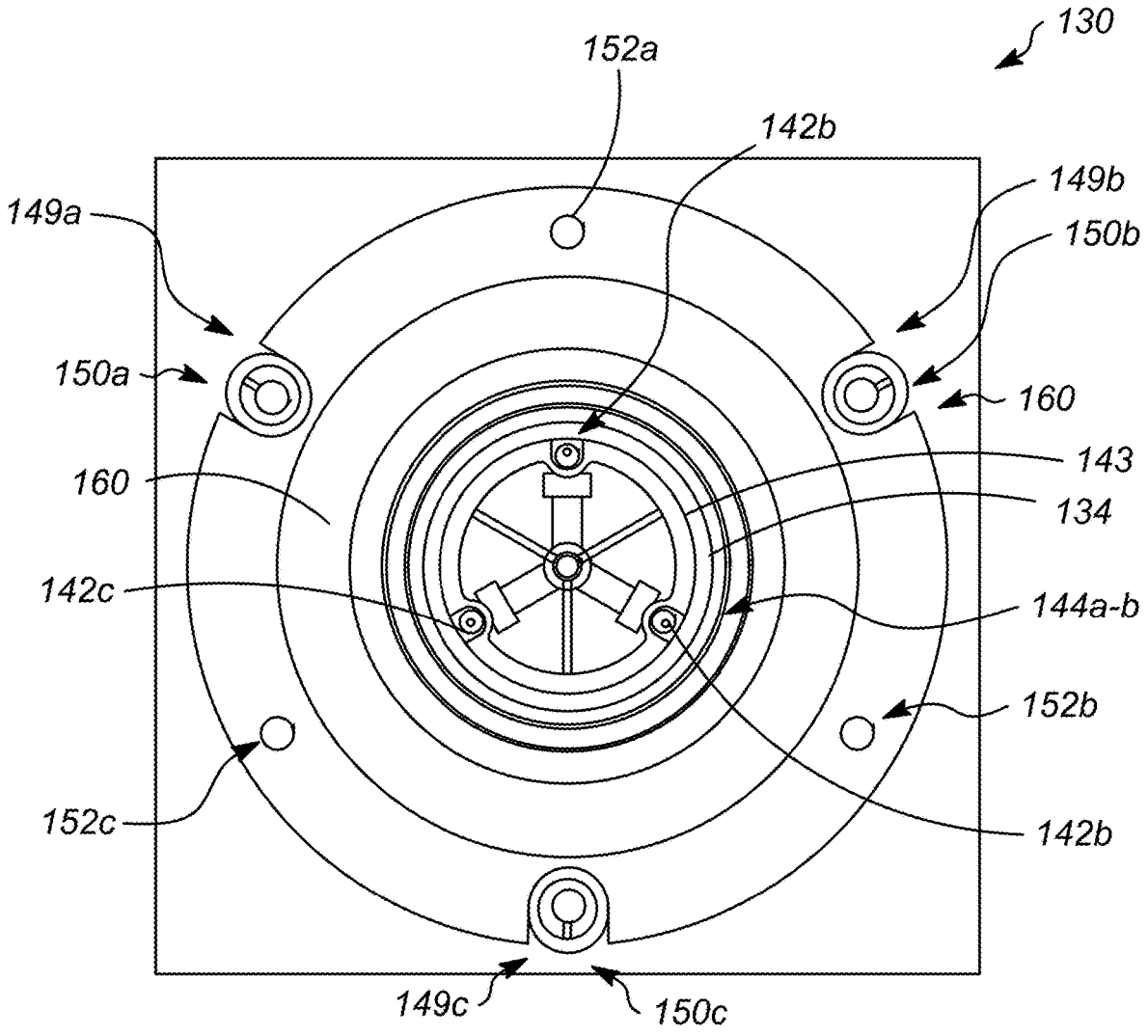
FIG. 5 shows an end view of an embodiment of the present burner system.

As shown in FIG. 5, an end view of the burner tile shows the primary tips and secondary tips. Ports 152*a*-152*c* for further secondary tips (see FIG. 8) are provided between the secondary tips 150*a*-150*c*.

Figure 6A:
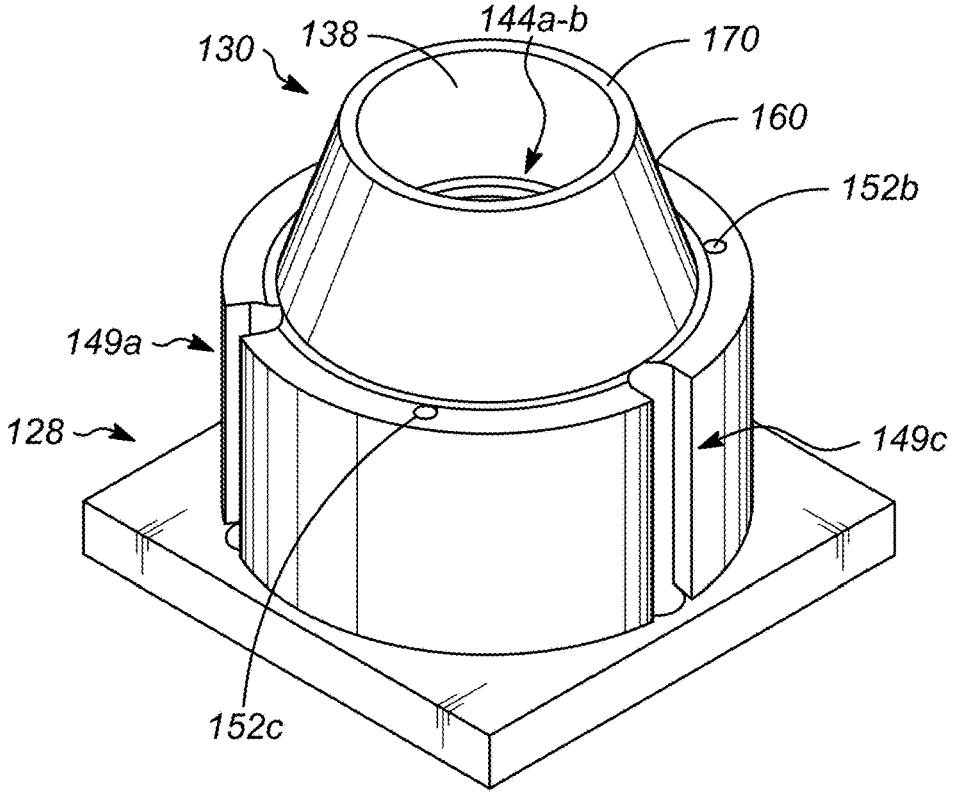
FIG. 6A shows a perspective view of an embodiment of the present burner system.

As shown in FIG. 6A, a perspective view of the burner tile 130 shows a square base section. The downstream portion of the burner tile has an annular cross section and two cavities are disposed on the inner wall of the downstream portion. The burner tile has ports 149*a*-149*c* near the outer wall of the downstream portion for the secondary tips (not shown). Further ports 152*a*-152*c* are provided for further secondary tips (not shown).

Figure 6B:
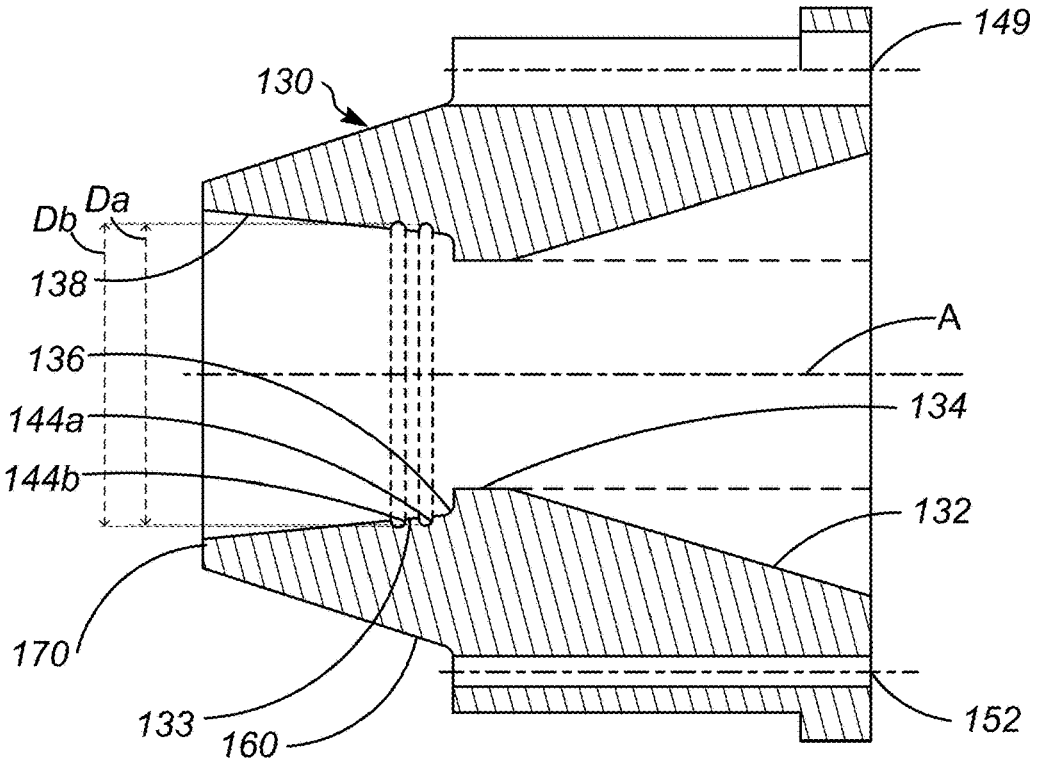
FIG. 6B shows a sectional view of an embodiment of the present burner system.

FIG. 6B shows a cross section of the burner tile. In the illustrated embodiment, the upstream portion 132, the throat 134, and the downstream portion are symmetrical with respect to the longitudinal axis A of the burner tile. The inner wall comprises a shoulder at the downstream end of the throat. The cavities 144*a*-144*b* are disposed downstream of the throat 134 and each have a round cross section. In the illustrated embodiment, the inner wall 138 is sloped, and the upstream cavity 144*a* has a smaller diameter Da than the downstream cavity 144*b* db. An intermediate portion 133 of the inner wall 138 is disposed between the cavities 144*a*-144*b* and is flat. The illustrated embodiment shows a burner tile 130 having a round cross section, and it is contemplated that in other embodiments, the burner tile may have one or more flat walls, preferably forming a square cross section.

The outer portion of the burner tile comprises ports 149 for a secondary tip (not shown) and further port 152 for a further tip (not shown). The outer wall 160 of the burner tile tapers inward toward an outlet portion 170 that has an annular cross section. In the illustrated embodiment, cavities are provided on the inner surface. However, in another embodiment, cavities are disposed on the outer surface of the burner tile proximate to the secondary tips.

Figure 7A:
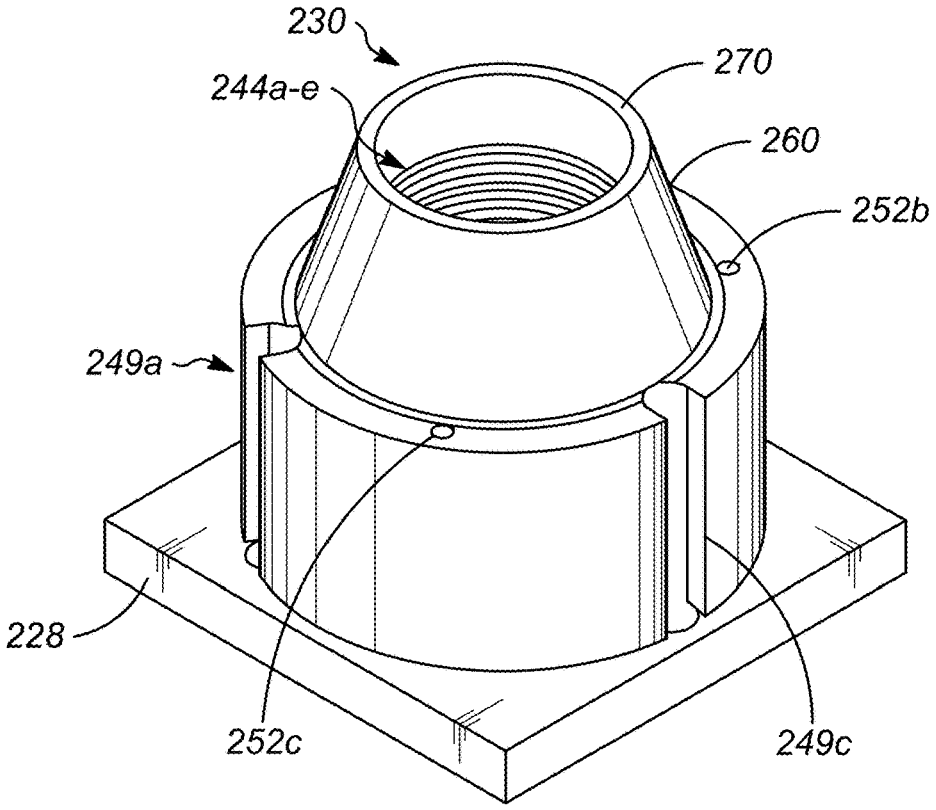
FIG. 7A shows a perspective view of a further embodiment of the present burner system.
Figure 7B:
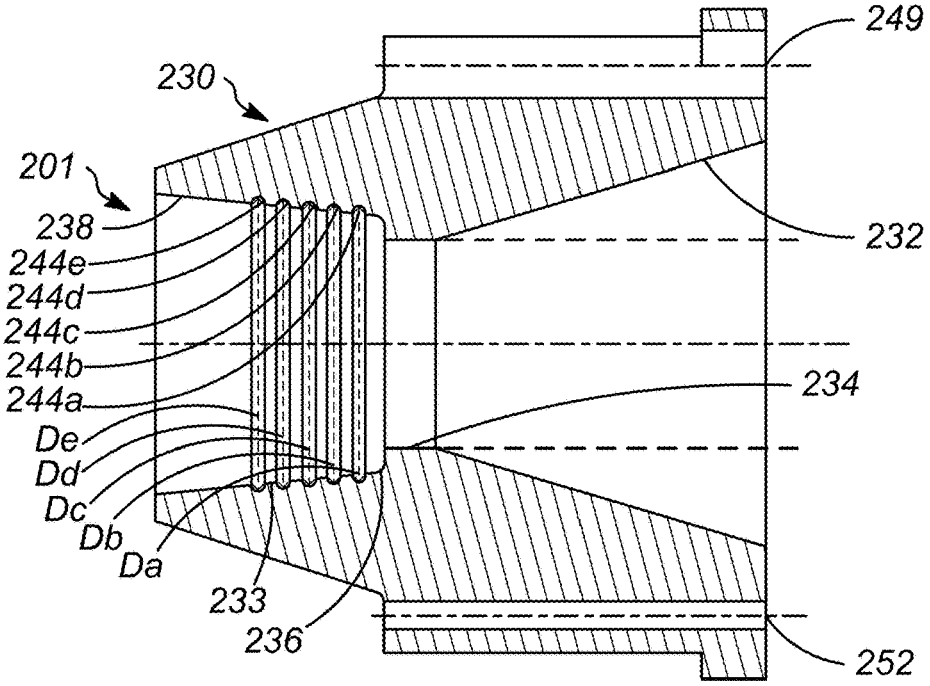
FIG. 7B shows a sectional view of the further embodiment of the present burner system.

As shown in FIGS. 7A and 7B, a further embodiment of a burner tile 230 has five cavities 244*a*-244*e*. the upstream portion 232 is sloped and the throat 234 is flat. Each of the plurality of cavities 244*a*-244*e* is disposed at a different distance relative to the throat 234 of the tile 230 in the combustion zone 201. The diameters Da-De of each of the plurality of cavities 244*a*-244*e* increase in a downstream direction. As shown in FIG. 7B, the upstream cavity 244*a* has the smallest diameter Da and the downstream cavity 244*e* has the largest diameter De. Intermediate portions 233 of the inner wall 238 disposed between the cavities 244*a*-244*e* are flat.

Figure 8:
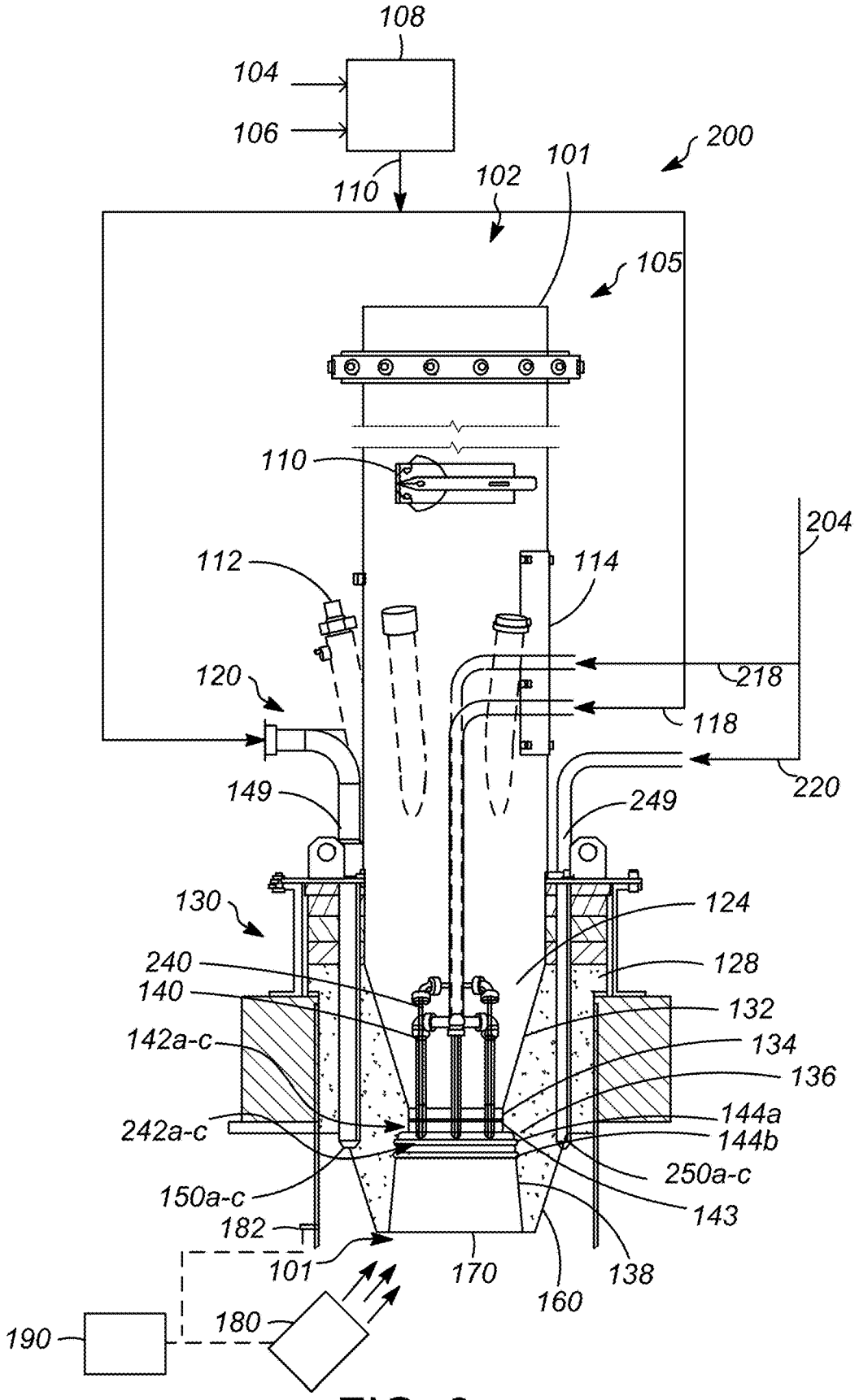
FIG. 8 shows sectional view of a further embodiment of the present burner system.

As shown in FIG. 8, a second embodiment of the burner system 200 is shown. The burner system has a further first portion of fuel gas 218 in a further primary conduit 240 and a further second portion of fuel gas 220 in a further secondary conduit 248. A further fuel gas stream 204 is also included. The further fuel gas stream comprises a NOx reducing medium, preferably a PSA tail gas. The further primary conduit comprises further primary tips 242*a*-*c*, and the further secondary conduit comprises further secondary tips 250*a*-*c*.

As shown in FIGS. 9A-9F, various passive and active burner schemes for burner systems 100, 200 are provided.

Passive Mode

Figure 9A:
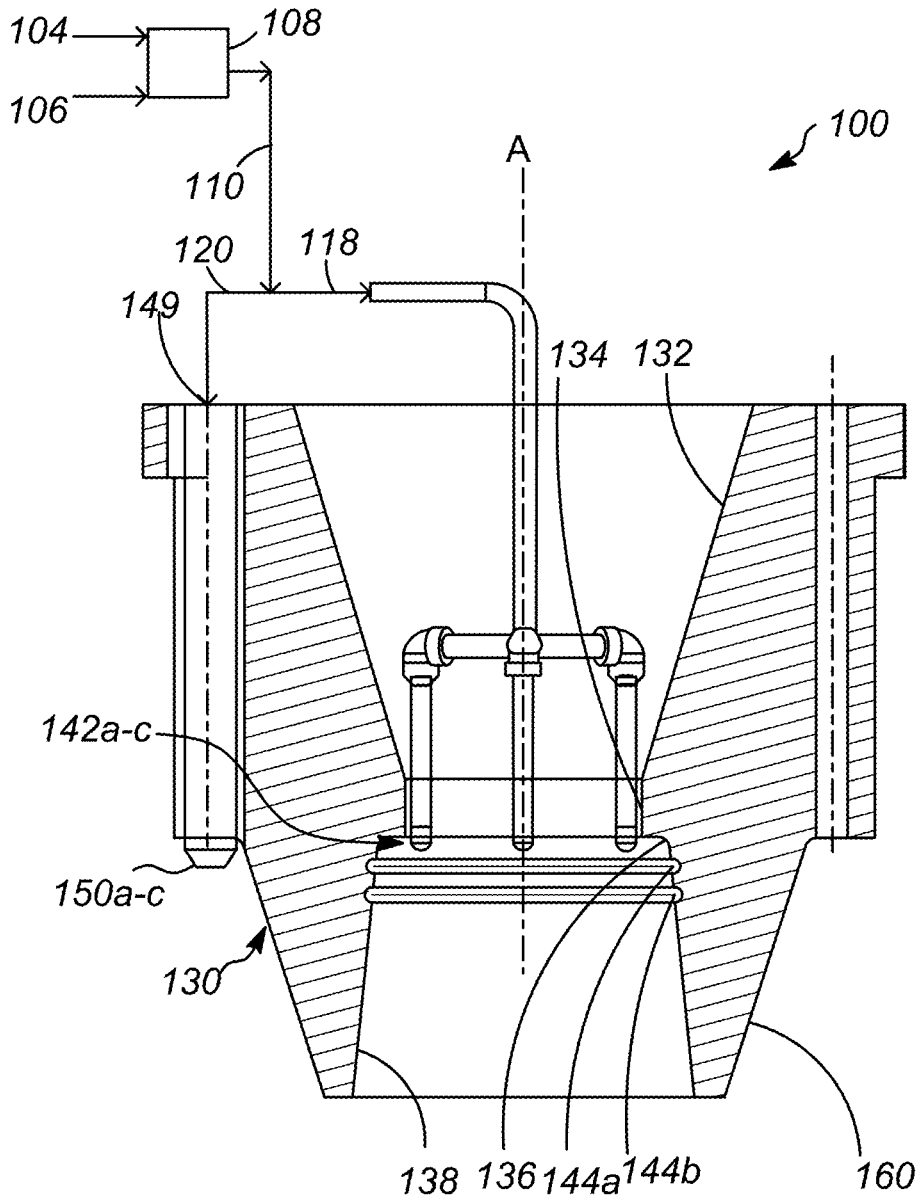
FIGS. 9A-9F shows sectional views of an embodiment of the present burner system.

FIG. 9A illustrates a passive mode of operation. This scheme depicts in cylindrical cross-section the burner system 100 for a passive mode of operation. This is a Mixed Fuel gas where Fuel Flow C is a premixture of natural gas trim fuel 104 and PSA tail gas 106. The proportion of primary fuel gas, the smaller interior gas nozzles (primary tips 142*a*-*c*), to staged fuel gas, the outer larger fuel gas nozzles (secondary tips 150*a*-*c*), is fix by proportional sizing of the gas jets or orifices at the end of each gas nozzle. While only three primary (central) and three staged or secondary (peripheral) gas tips are depicted, there may be a multiplicity of each tip on a given burner. In most cases there will be a multiplicity of like burners in a given furnace service.

In this passive embodiment, the fuel gas naturally finds flame stability in the appropriate cavity or cavities 144*a*, 144*b* disposed immediately downstream of the primary gas injection nozzles (primary tips 142*a*-*c*). As the fuel gas composition, flow rate, and pressure vary and as the overall stoichiometry of the burner varies, the location or locations of fuel gas stabilization will naturally migrate utilizing the cavities 144*a*, 144*b* for stabilization.

Figure 9B:
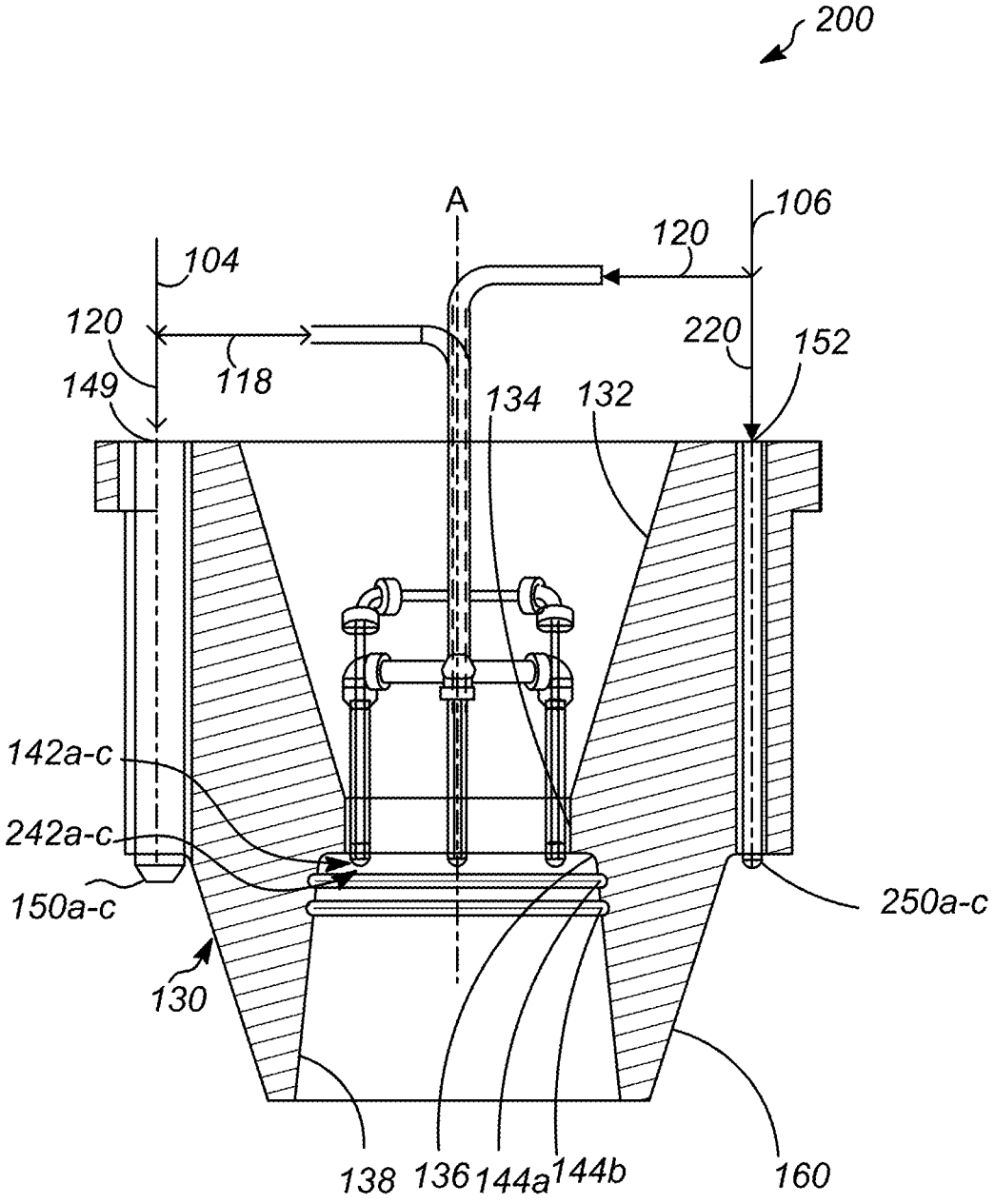

FIG. 9B illustrates a further passive mode having two fuel streams. This scheme depicts two separate fuel gas streams 104, 106 to two separate sets of primary tips (primary tips 142*a*-142*c* and further primary tips 242*a*-242*c*) and secondary fuel gas nozzles (secondary tips 150*a*-150*c* and further secondary tips 250*a*-250*c*). This arrangement is passive in that if Fuel Flow B is the PSA Tail Gas, all that gas stream from the process unit is received by the burner(s). The Fuel Flow A may represent the trim fuel, natural gas or refinery gas that is modulated to achieve process outlet temperature requirements.

This scheme is passive for the same reasons as scheme A. In either Scheme A or B, the proportion of primary to secondary fuel of either fuel or any fuel gas stream may vary from 0% to 100%. For example, Fuel Flow A may be as great as 100% to the burner primary and Fuel Flow B may be 100% secondary or staged. These proportions are fixed, by design in the passive cases.

Active Mode

Figure 9C:
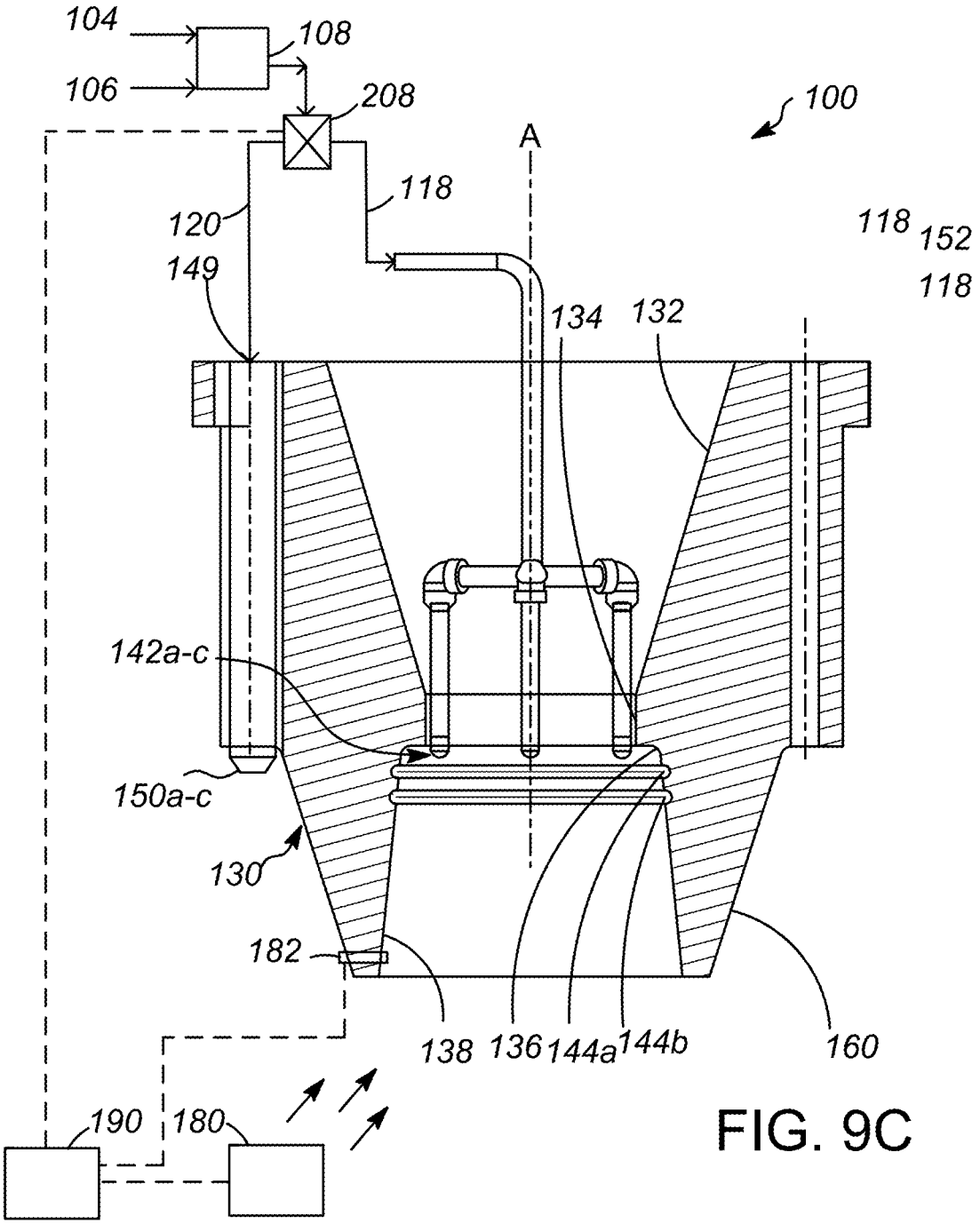

FIG. 9C shows an active mode. In the active cases, one or more sensors or operational data may be used to monitor or predict the condition of the flame, flame stability and shape and NOx and other emissions levels. In the active case, sensors may be used singly or in concert with other sensors. A micro-processor or similar device adjusts a valve positioned in the fuel flow stream between the primary and secondary gas streams. In the illustrated embodiments, the valve 208 may be one or more control valves, preferably a three-way control valve.

Sensors for adjustment of the proportioning valve may include but are not limited to flow meters, pressure sensors, thermocouples, chromatographs, calorimeters, oxygen sensors, cameras, flame ionization detectors, photoionization detectors, "multispectral flame detectors including infrared and ultraviolet flame scanners and combination UV/IR detectors. Cameras include visual field cameras, infrared cameras, and full spectrum cameras.

Fuel gas flow rate is measured in the first conduit and or the second conduit and allows the burner system to sense changing fuel supply conditions. Changes to fuel pressure and temperature to the burner(s) can also be measured at the first and second conduit.

Fuel composition may be ascertained from an online gas chromatograph. Similarly, fuel heating value from an online calorimeter.

Other downstream parameters can be measured in order to reflect the operational state of the burner. Furnace operating parameters including firebox and combustion air duct pressure, flue gas oxygen, nitric oxide, carbon monoxide, unburned hydrocarbon, and volatile organic compound emissions concentrations in flue gas; radiant section flue gas temperature; process inlet and outlet temperatures.

The sensor 180 of the illustrated embodiment is a Visual Field or Multispectral (into IR or UV spectrum) camera for Artificial Intelligence imaging (depicted in FIG. 4). It is important that the camera 180 is positioned so it can view the flame present on the plurality of cavities 144*a-b* of the burner tile wall in the combustion zone 101.

A further sensor 182 is a high-speed furnace combustion chamber pressure transmitter (depicted in FIG. 4). Additional UV and/or IR Flame detectors are not shown.

Further furnace or process unit operational historical or predicted data such may be used to control the stability of the flame in conjunction with the parameters obtained from the sensors described herein. Operational Data may include but is not limited to predicted fuel gas composition as related to fuel gas pressure; burner stability prediction for various firing cases or sets of operational conditions; NOx, CO, Oxygen, Unburned Hydrocarbon and Volatile Organic Compound emissions.

The burner system is operated in Active Mode by monitoring a set of operating conditions via sensors 180 and 182. The controller 190 receives input signals and generates output signals to control one or more valves. Accordingly flame stability is optimized.

For example, at light-off or startup, the firebox temperature is cold, close to ambient temperature and much less than 1,400° F. (760° C.) and substantially all, or a greater proportion, of the fuel may be directed to the inner primary gas tips which may ensure flame stability while minimizing CO emissions. In this mode the multispectral camera can act as a flame detector. Then as the firebox temperature increases to near or over 1,400° F. (760° C.), some fuel can be directed to the stage gas nozzles, the CO emissions should become nil and the NOx emissions will rise. As firebox temperatures further increase, the fuel gas flow through the primary tips may be shut off completely to minimize NOx formation.

If the AI camera images show unstable operation or operation outside reference image tolerances, the fuel can be redirected more towards the primary gas tips and less to the secondary gas tips.

Further, the high-speed pressure transmitter data will be compared against reference stable/unstable pressure fluctuation signatures and the primary fuel gas can be reduced until onset of instability is reached and the primary proportion can be increased marginally to achieve operational stability with lowest NOx for a given fuel gas.

This high-speed pressure transmitter 182 is principally a control sensor rather than an alarm or shutdown sensor. The pressure sensor data is used to modulate primary/secondary fuel split or proportion.

While the lowest NOx emissions may be produced when the burner 10 is receiving highest rates of NOx reducing medium, this may also be the incipient point of burner instability. However, this incipient instability can be detected by a high-speed pressure transmitter and associated instability detection software similar to that described in U.S. Pat. No. 7,950,919 Johnson, et al. However, unlike U.S. Pat. No. 7,950,919 where principally combustion chamber oxygen is controlled and adjusted to react to instability, in this disclosure, the rate and location of NOx reducing medium can be controlled.

Generally, the NOx emissions from the heater may be monitored along with the stack oxygen and the combustion chamber pressure or draft. The rate, the amount of NOx reducing medium delivered is increased at the desired locations in the flame zone until the required NOx reduction is achieved. Once the desired NOx level is achieved no additional NOx reducing medium may be introduced. And if the burner becomes unstable, the rate and/or location of the NOx reducing medium can be controlled or the excess air, oxygen levels adjusted as suggested in U.S. Pat. No. 7,950,919 until burner stability is achieved.

It is further contemplated that visual field or infrared cameras may be used to monitor flame stability and quality aspects using artificial intelligence, AI, such as described in U.S. Patent Publ. No. 2020/0386404. When instabilities or other anomalies in the flame image are detected with the AI, the amount and location of the NOx reducing medium and/or other control aspects of the heater controls system, such as excess oxygen, can be adjusted and controlled to simultaneously deliver the lowest level of NOx (or at least the required level) with good burner flame stability.

If there is a loss of NOx reducing medium at any time or at any moment, the present burner 10 will still work safely as a conventional low NOx burner. The NOx emissions may increase, but the burner 10 will otherwise remain stable and continue to deliver heat reliably to the process in the heater, boiler, or furnace. Further, the burner 10 will operate, in the view of the burner operator, just as conventional burners operate with no special operational issues.

The introduction of NOx reducing medium is by fix, static control devices or by automated computer control. Therefore, the burner operates, to the point of view of the operator, conventionally with draft and oxygen control as prescribed in API Recommended Practice 535, Third Edition, May 2014, Burners for Fired Heaters in General Refinery Service. Namely draft and oxygen are controlled with the stack damper and burner air inlet register and/or the induced draft fan and forced draft fan control settings.

It should be appreciated and understood by those of ordinary skill in the art that various other components, such as valves, pumps, fans, filters, coolers, etc., may not be shown in the drawings as it is believed that the specifics of same are well within the knowledge of those of ordinary skill in the art and a description of same is not necessary for practicing or understanding the embodiments of the present disclosure.

Any of the above lines, conduits, units, devices, vessels, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring component, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

The computing device of system unit may comprise, for example, any type of general-purpose microprocessor or microcontroller, a digital signal processing (DSP) processor, a central processing unit (CPU), an integrated circuit, a field programmable gate array (FPGA), a reconfigurable processor, other suitably programmed or programmable logic circuits, or any combination thereof.

The memory may be any suitable known or other machine-readable storage medium. The memory may comprise non-transitory computer readable storage medium such as, for example, but not limited to, an electronic, magnetic, optical, electromagnetic, infrared, or semiconductor system, apparatus, or device, or any suitable combination of the foregoing. The memory may include a suitable combination of any type of computer memory that is located either internally or externally to the device such as, for example, random-access memory (RAM), read-only memory (ROM), compact disc read-only memory (CD-ROM), electro-optical memory, magneto-optical memory, erasable programmable read-only memory (EPROM), and electrically-erasable programmable read-only memory (EEPROM), Ferroelectric RAM (FRANI) or the like. The memory may comprise any storage means (e.g., devices) suitable for retrievably storing the computer-executable instructions executable by the controller or a computing device.

The methods and steps described herein may be implemented in a high-level procedural or object-oriented programming or scripting language, or a combination thereof, to communicate with or assist in the operation of the controller or computing device. Alternatively, the methods and systems described herein may be implemented in assembly or machine language. The language may be a compiled or interpreted language. Program code for implementing the methods and systems for control gas flow to a burner described herein may be stored on the storage media or the device, for example a ROM, a magnetic disk, an optical disc, a flash drive, or any other suitable storage media or device. The program code may be readable by a general or special-purpose programmable computer for configuring and operating the computer when the storage media or device is read by the computer to perform the procedures described herein.

Computer-executable instructions may be in many forms, including program modules, executed by one or more computers or other devices. Generally, program modules include routines, programs, objects, components, data structures, etc., that perform particular tasks or implement particular abstract data types. Typically, the functionality of the program modules may be combined or distributed as desired in various embodiments.

Figure 9D:
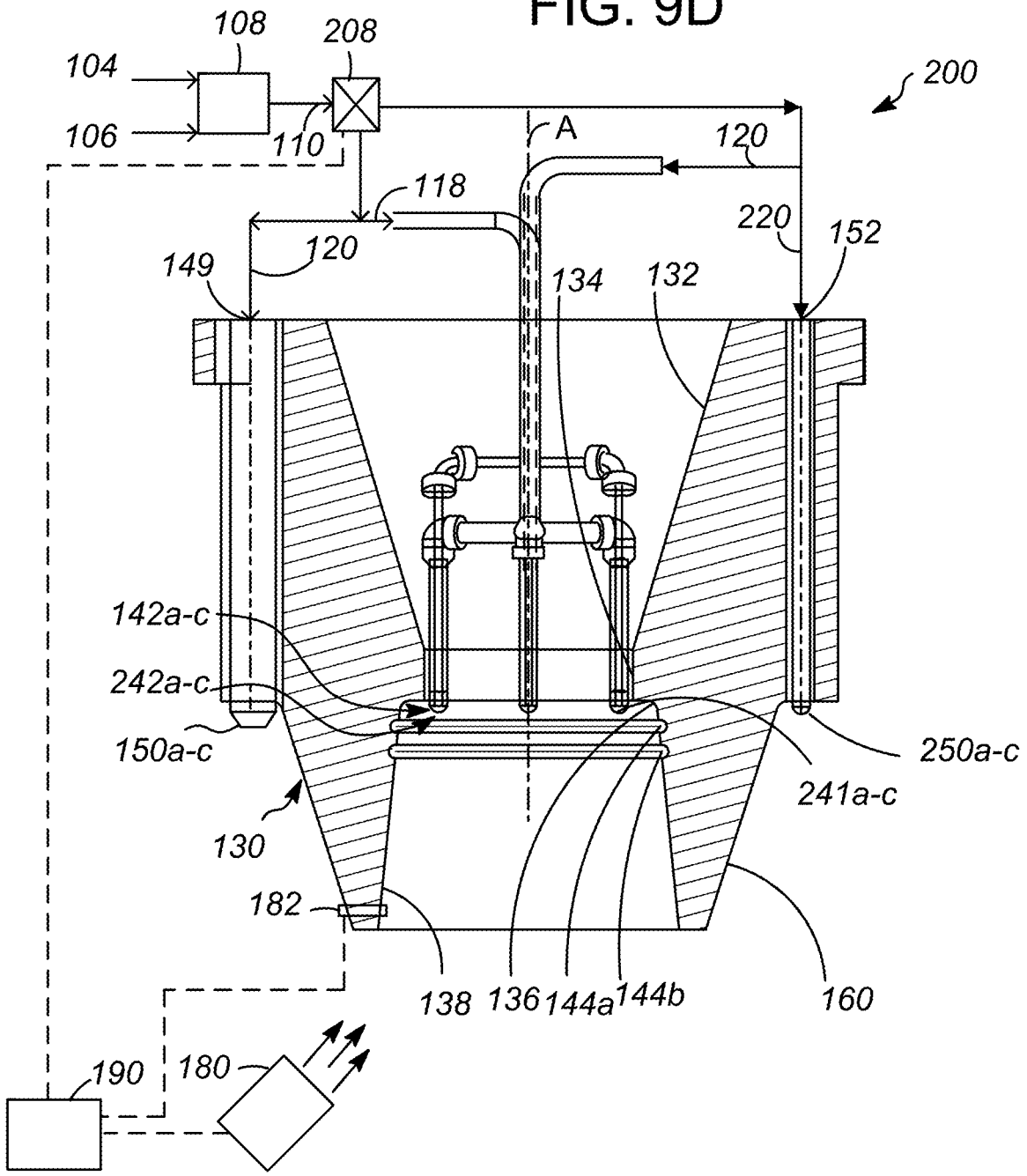

FIG. 9D shows a further active mode. Where Scheme C addresses a single fuel flow stream to a single set of primary and secondary tips, Scheme D can be used to address multiple sets of primary and secondary tips. One set of injection nozzles (primary tips 142*a*-142*c* and secondary tips 150*a*-150*c*) is designed for a high-pressure natural gas or refinery gas nozzles, and a further set (further primary tips 242*a*-242*c* and further secondary tips 250*a*-250*c*) is designed for 14.5 to 29 psig (1 to 2 barg). The second set of tips (further primary tips 242*a*-242*c* and further secondary tips 250*a*-250*c*) is preferably designed of a process off-gas or tail gas at lower pressure of around 2 to 5 psig (0.14 to 0.34 barg). As input data about the fuel composition and pressure change and sensor data change, the proportion to each set of gas tips can be proportionally altered from 100% one set to 100% the other and proportion between the two via control valve 208.

Changing the proportion of fuel gas routed to the primary tips 142*a*-142*c* and secondary tips 150*a*-150*c* in Scheme C or high-pressure/low-pressure in Scheme D alters the stabilization cavity(s) for which one set of gas nozzles in optimized to feed and produce a stable flame.

Figure 9E:
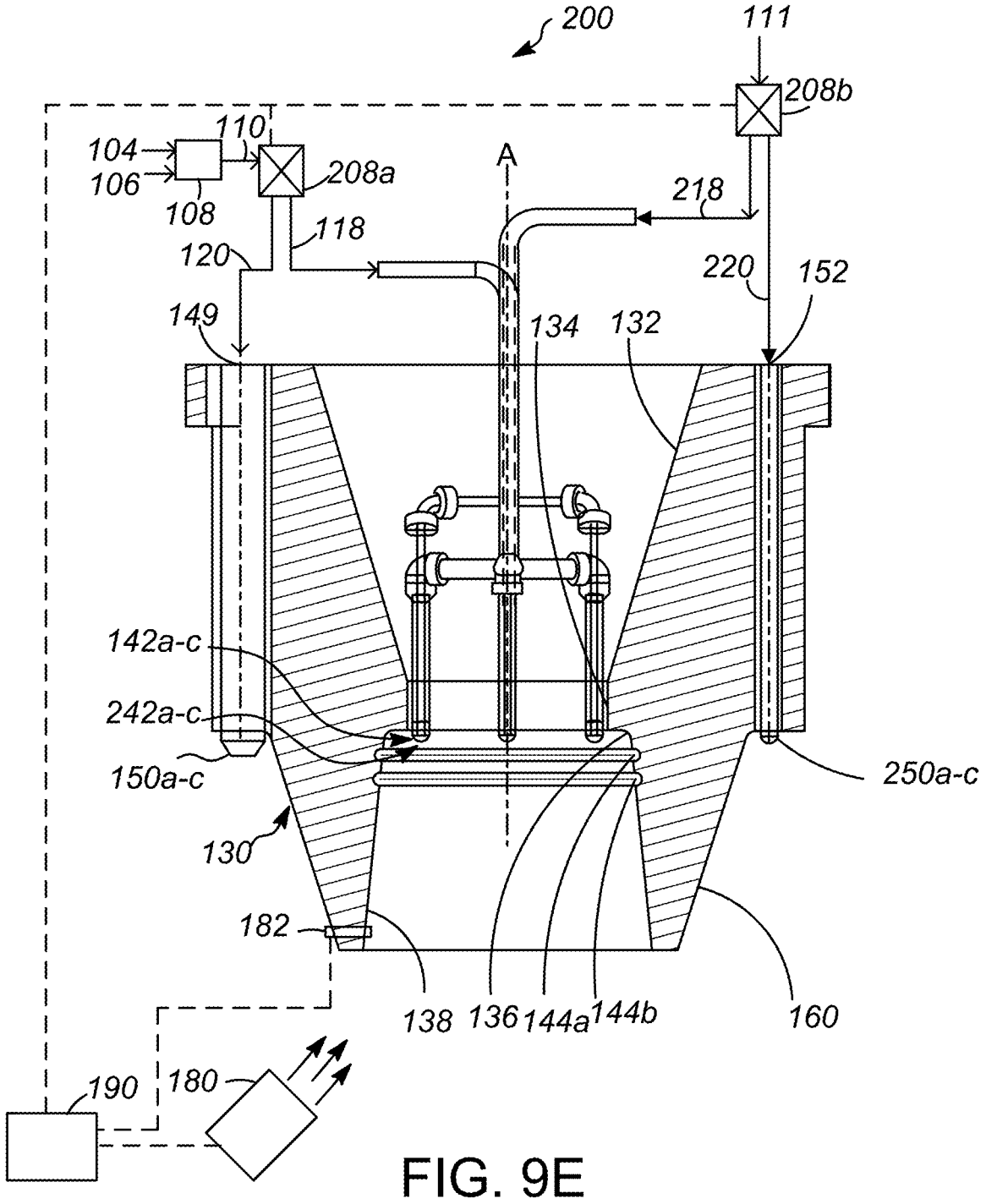

FIG. 9E shows a further active mode. With Scheme E, the burner system 200 can actively address two or more highly variable fuel sources 104, 106, and a further fuel gas stream 111 varying in both composition and pressure. Multiple control valves 208*a* 208*b* are used to separately vary the mixed fuel gas flow to the separate sets of gas nozzles with variable primary/secondary gas ratios and directing the gas to the specific stabilization cavities for optimized for the various cases.

Figure 9F:
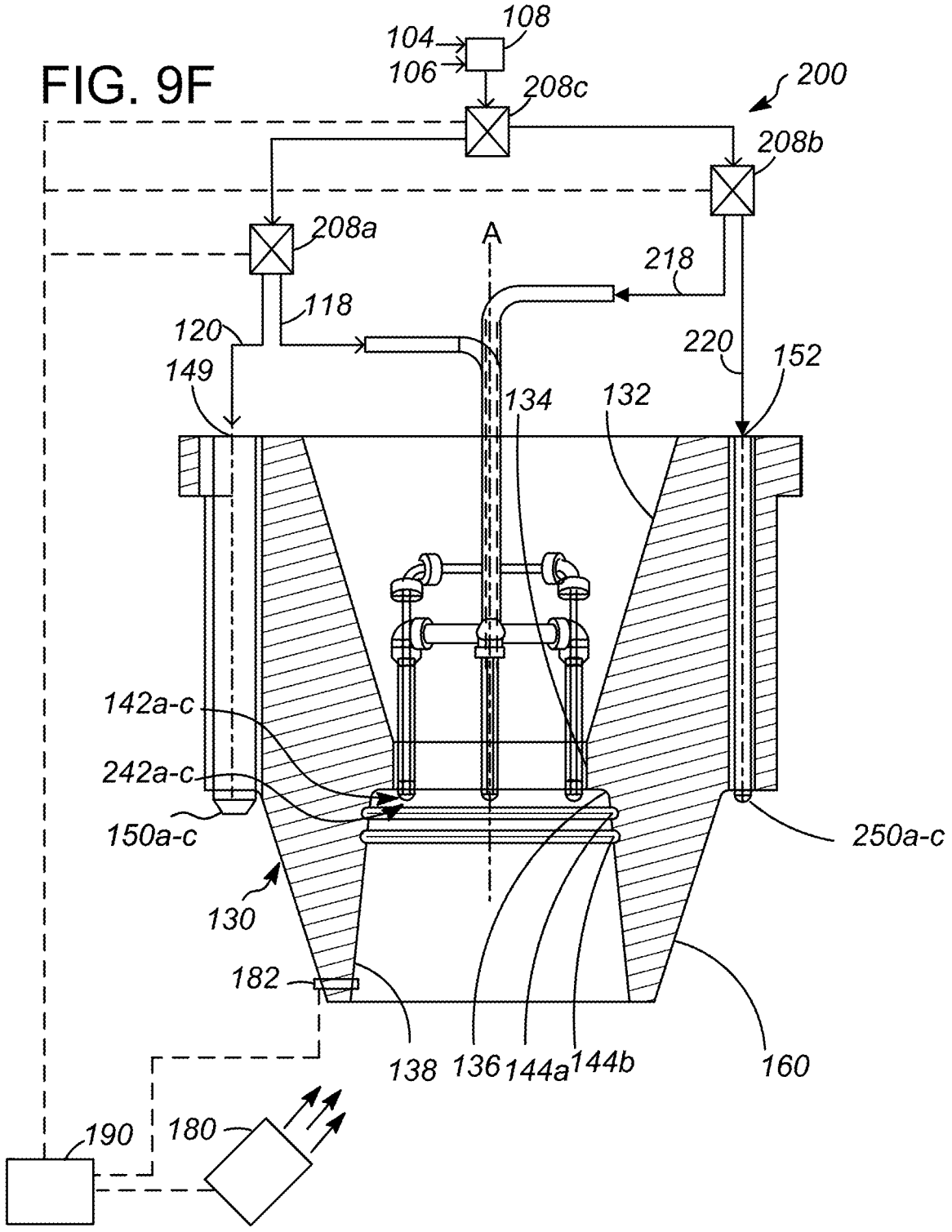

FIG. 9F shows a further active mode. Scheme F, we can actively address highly variable, mix or single fuel sources. Three control valves 208*a*-208*c* are used to vary in both composition and pressure, by separately varying the primary/secondary split of two or more separate sets of gas tips with the ability to switch completely from one set to another. One set of nozzles (primary tips 142*a*-142*c* and secondary tips 150*a*-150*c*) is optimized for a high-pressure fuel gas, over 14.5 psig (1 barg) design pressure, and the other set (further primary tips 242*a*-242*c* and further secondary tips 250*a*-250*c*) are designed for low pressure fuel gas of less than 3 psig (0.2 barg) design pressure.

EXAMPLE

Figure 10A:
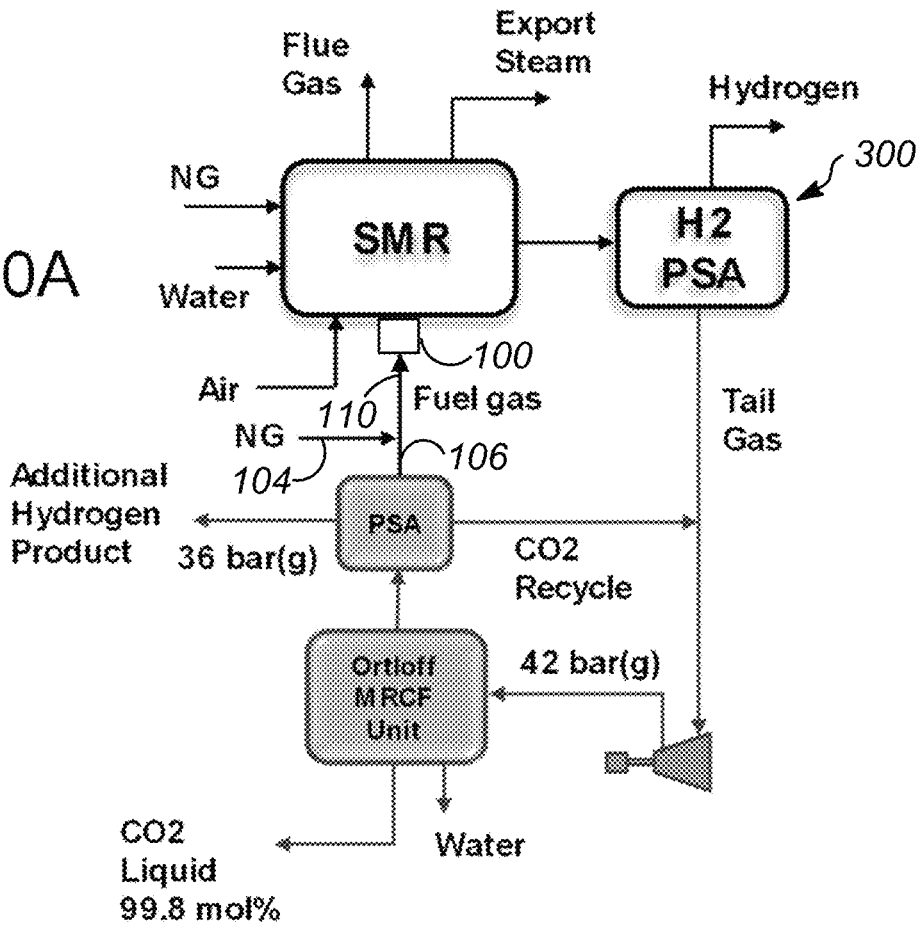
FIGS. 10A and FIG. 10B show an embodiment of the present burner system in example processes.
Figure 10B:
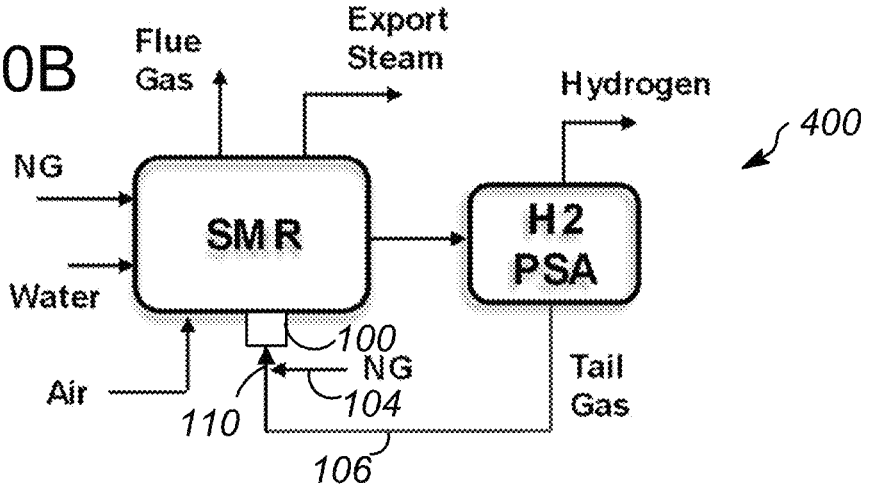

As shown in FIGS. 10A and 10B, fuel streams entering a burner system 100 (or burner system 200) in an example process 300, 400 are shown having a $CO_2$ capture mode and a bypass mode. In the illustrated embodiments, the burner system 100 is mounted on a steam methane reforming unit (SMR). The first fuel source is natural gas, and the second fuel gas stream is a PSA tail gas stream.

Further, the fuel gas streams, whether mixed or separate, may vary further in compositions from 100% natural gas (mostly methane) to 100% pure hydrogen to refinery fuel gas blends (composed of varying amounts of methane, hydrogen, and heavier gaseous hydrocarbons).

There may one, two, three or more rapidly changing fuel gas streams delivered to these burners.

Note that a chemical processing unit creates the PSA tail gas and all produced PSA tail gas must go to and be consumed by the burners. However, this PSA tail gas is not sufficient to sustain process outlet temperature requirements and therefore additional "trim" gas is used to achieve desired process temperature.

The tables below show an example embodiment. In an embodiment where the fuel gasses are premixed, the mixed fuel column illustrates the components of the mixed fuel stream. In the embodiments where the first fuel gas is a PSA tail gas (fuel stream containing one or more NOx reducing mediums), and a second fuel gas is natural gas (NG), the table below illustrates the composition of the fuel streams.

BYPASS MODE

| | Mixed Fuel | Separate Trim Fuel: PSA Tail Gas | Separate Trim Fuel: NG |
|---|---|---|---|
| Flow, lbmol/hr | 5377 | 4804 | 573 |
| Temp, Celsius | 35 | 35 | 35 |
| Pressure, psig | 3 | 3 | 20 |
| Mol % | | | |
| $H_2$ | 21.3 | 23.9 | 0.0 |
| CO | 7.1 | 7.9 | 0.0 |
| Cl | 20.9 | 12.5 | 92.0 |
| $H_2O$ | 1.0 | 1.1 | 0.0 |
| $CO_2$ | 48.3 | 53.9 | 0.5 |
| Ethane | 0.5 | 0.0 | 5.0 |
| Propane | 0.1 | 0.0 | 1.0 |
| n-Butane | 0.05 | 0.0 | 0.5 |
| $N_2$ | 0.7 | 0.7 | 1.0 |
| Total | 100.0 | 100.0 | 100.0 |
| MW, lb/lbmol | 27.6 | 28.8 | 17.5 |

CO2 CAPTURE MODE

| | Mixed Fuel | Separate Trim Fuel: PSA Tail Gas | Separate Trim Fuel: NG |
|---|---|---|---|
| Flow, lbmol/hr | 1917 | 1137 | 780 |
| Temp, Celsius | 35 | 35 | 35 |
| Pressure, psig | 3 | 3 | 20 |
| Mol % | | | |
| $H_2$ | 6.0 | 10.1 | 0.0 |
| CO | 19.9 | 33.6 | 0.0 |
| Cl | 68.9 | 52.8 | 92.0 |
| $H_2O$ | 0.0 | 0.0 | 0.0 |
| $CO_2$ | 0.5 | 0.6 | 0.5 |
| Ethane | 2.0 | 0.0 | 5.0 |
| Propane | 0.4 | 0.0 | 1.0 |
| n-Butane | 0.2 | 0.0 | 0.5 |
| $N_2$ | 2.1 | 2.9 | 1.0 |
| Total | 100.0 | 100.0 | 100.0 |
| MW, lb/lbmol | 18.4 | 18.4 | 17.5 |

In the tables above, operating in the passive mode, the mixed fuel represents the content of a common fuel gas stream sent to the primary tip and secondary tips. The tables above illustrate how drastically the C1 content increases and the $CO_2$ decreases when the system changes from bypass mode to carbon dioxide capture mode.

In the active mode, the NG (natural gas) stream 104 is the fuel gas sent to the primary tips and the PSA Tail Gas 106 is the secondary fuel stream send to the secondary tips. In the Bypass mode, shown in FIG. 14B, the PSA Tail Gas is received from a Hydrogen PSA system. In the $CO_2$ capture mode, shown in FIG. 14A, the PSA Tail Gas is produced from a further PSA system.

Specific Embodiments

While the following is described in conjunction with specific embodiments, it will be understood that this description is intended to illustrate and not limit the scope of the preceding description and the appended claims.

A first embodiment of the invention is a burner comprising a plenum; a burner tile configured to provide combustion air from the plenum through the burner tile to a combustion zone, the burner tile having an upstream portion, a throat, and a downstream portion, the downstream portion having a wall and a plurality of cavities disposed on the wall; and at least one primary conduit having a plurality of primary tips configured to inject a fuel stream comprising fuel gas into the combustion zone, wherein each of the primary tips comprising a plurality of ports. An embodiment of the invention is one, any or all of prior embodiments in this paragraph up through the first embodiment in this paragraph, further comprising at least one secondary conduit having a plurality of secondary tips configured to inject a second portion of a second fuel stream downstream of the primary tips. An embodiment of the invention is one, any or all of prior embodiments in this paragraph up through the first embodiment in this paragraph, wherein the secondary tips are disposed radially outward with respect to the primary tips and wherein the secondary tips are disposed along an outer wall of the burner tile. An embodiment of the invention is one, any or all of prior embodiments in this paragraph up through the first embodiment in this paragraph, wherein the wall of the burner tile is an inner wall that comprises a curved shoulder and a planar portion, and wherein each of the plurality of cavities is disposed on the planar portion. An embodiment of the invention is one, any or all of prior embodiments in this paragraph up through the first embodiment in this paragraph, wherein the burner tile has an annular cross section and each of the plurality of cavities is defined by a curved cross section. An embodiment of the invention is one, any or all of prior embodiments in this paragraph up through the first embodiment in this paragraph, wherein each of the plurality of cavities has a different diameter and is disposed at a different distance relative to the throat of the burner tile. An embodiment of the invention is one, any or all of prior embodiments in this paragraph up through the first embodiment in this paragraph, wherein each primary tip comprises a lateral port and an end port, wherein the lateral port is disposed on a side of the primary tip and is angled toward the inner wall of the burner tile. An embodiment of the invention is one, any or all of prior embodiments in this paragraph up through the first embodiment in this paragraph, wherein each end port is disposed at a distal end of the primary tip and is angled toward the wall of the burner tile. An embodiment of the invention is one, any or all of prior embodiments in this paragraph up through the first embodiment in this paragraph, wherein each secondary tip comprises a lateral port and an end port, wherein the lateral port of each secondary tip is disposed on a side of the secondary tip and is angled toward an outer wall of the burner tile, and wherein the end port of each secondary tip is disposed at a distal end of the secondary tip and is angled toward the outer wall of the burner tile. An embodiment of the invention is one, any or all of prior embodiments in this paragraph up through the first embodiment in this paragraph, wherein the first conduit comprises a plurality of further secondary tips and wherein the second conduit comprises a plurality of further primary tips.

A second embodiment of the invention is a burner comprising a plenum; a burner tile arranged such that combustion air from the plenum flows from the plenum through the burner tile to a combustion zone, the burner tile having an upstream portion, a throat, and a downstream portion, the downstream portion having wall, and the burner tile further comprising a plurality of cavities disposed on the wall; at least one primary conduit having a plurality of primary tips configured to inject a fuel stream comprising fuel gas into the combustion zone; at least one secondary conduit having a plurality of secondary tips configured to inject a second fuel stream; at least one sensor configured to sense one or more aspects of the combustion zone; a valve in fluid communication with the primary conduit and the secondary conduit; and a controller that receives inputs from the at least one sensor, wherein the controller is configured to operate the valve to control the one or more aspects of the combustion zone. An embodiment of the invention is one, any or all of prior embodiments in this paragraph up through the second embodiment in this paragraph, wherein the second portion of fuel gas is injected downstream relative to the first portion fuel gas. An embodiment of the invention is one, any or all of prior embodiments in this paragraph up through the second embodiment in this paragraph, wherein the wall of the burner tile is an inner wall. An embodiment of the invention is one, any or all of prior embodiments in this paragraph up through the second embodiment in this paragraph, wherein the sensor is one of a camera, a pressure sensor, a thermocouple, a flame detector, a calorimeter, or a chromatograph. An embodiment of the invention is one, any or all of prior embodiments in this paragraph up through the second embodiment in this paragraph, wherein the valve is a three-way control valve configured to control a proportion of fuel gas flow in the primary conduit and a proportion of fuel gas flow in the secondary conduit. An embodiment of the invention is one, any or all of prior embodiments in this paragraph up through the second embodiment in this paragraph, wherein the first conduit comprises a plurality of further secondary tips and wherein the second conduit comprises a plurality of further primary tips. An embodiment of the invention is one, any or all of prior embodiments in this paragraph up through the second embodiment in this paragraph, wherein the valve is a three-way control valve configured to control a proportion of fuel gas flow in the primary conduit and a proportion of fuel gas flow in the secondary conduit, and a further control valve is configured to control a proportion of fuel gas flow in the plurality of further secondary tips and the plurality of further primary tips. An embodiment of the invention is one, any or all of prior embodiments in this paragraph up through the second embodiment in this paragraph, wherein the valve is a three-way control valve configured to control a proportion of fuel gas flow in the primary conduit and a proportion of fuel gas flow in the secondary conduit, and a further three-way control valve is configured to control a proportion of fuel gas flow in the plurality of further secondary tips and the plurality of further primary tips; and wherein a main valve in communication with a mixed gas source is provided and controls a proportion of mixed gas to the three-way control valve and the further control valve. An embodiment of the invention is one, any or all of prior embodiments in this paragraph up through the second embodiment in this paragraph, wherein the burner tile has an annular cross section and each of the plurality of cavities is defined by a curved wall.

A third embodiment of the invention is a process of operating a burner, the process comprising injecting combustion air into a combustion zone associated with a burner tile, the burner tile having an upstream portion, a throat, and a downstream portion, the downstream portion having a wall, the burner tile further comprising a plurality of cavities disposed on the wall; and injecting a first portion of fuel gas through a plurality of primary tips into the combustion zone, wherein the combustion air and the first portion of fuel gas produce a flame in the combustion zone. An embodiment of the invention is one, any or all of prior embodiments in this paragraph up through the third embodiment in this paragraph, injecting a second portion of fuel gas through a plurality of secondary tips, wherein the second portion of fuel gas comprises a NOx reducing medium. An embodiment of the invention is one, any or all of prior embodiments in this paragraph up through the third embodiment in this paragraph, wherein the second portion of fuel gas is injected downstream relative to the first portion of fuel gas. An embodiment of the invention is one, any or all of prior embodiments in this paragraph up through the third embodiment in this paragraph, wherein each of the primary tips injects the first portion of fuel gas through a lateral port and an end port. An embodiment of the invention is one, any or all of prior embodiments in this paragraph up through the third embodiment in this paragraph, wherein the lateral port is disposed on a side of the tip and is angled toward the inner wall of the burner tile. An embodiment of the invention is one, any or all of prior embodiments in this paragraph up through the third embodiment in this paragraph, wherein each end port is disposed at a distal end of the primary tip and is angled toward the inner wall of the burner tile. An embodiment of the invention is one, any or all of prior embodiments in this paragraph up through the third embodiment in this paragraph, wherein each secondary tip comprises a lateral port and an end port, wherein the lateral port of each secondary tip is disposed on a side of the tip and is angled toward the outer wall of the burner tile. An embodiment of the invention is one, any or all of prior embodiments in this paragraph up through the third embodiment in this paragraph, wherein the end port of each secondary tip is disposed at a distal end of the secondary tip and is angled toward the outer wall of the burner tile.

A fourth embodiment of the invention is a process of controlling a burner, the process comprising injecting combustion air into a combustion zone associated with a burner tile, the burner tile having an upstream portion, a throat, and a downstream portion, the downstream portion having a wall, the burner tile further comprising a plurality of cavities disposed on the wall; injecting a first portion of fuel gas from primary conduit through a plurality of primary tips and into the combustion zone, wherein the first portion of fuel gas and the combustion air produce a flame in the combustion zone; injecting a second portion of fuel gas from a secondary conduit through a plurality of secondary tips; detecting one or more aspects of the combustion zone; and controlling a proportion of the first portion of fuel gas in relation to the second portion of fuel gas using a valve in fluid communication with the primary conduit and the secondary conduit. An embodiment of the invention is one, any or all of prior embodiments in this paragraph up through the fourth embodiment in this paragraph, wherein the second portion of the fuel gas is injected downstream relative to the first portion of the fuel gas. An embodiment of the invention is one, any or all of prior embodiments in this paragraph up through the fourth embodiment in this paragraph, further comprising wherein the second portion of fuel gas is provided from a pressure swing absorption vessel. An embodiment of the invention is one, any or all of prior embodiments in this paragraph up through the fourth embodiment in this paragraph, further comprising providing the second portion of fuel gas that bypasses the pressure swing absorption vessel. An embodiment of the invention is one, any or all of prior embodiments in this paragraph up through the fourth embodiment in this paragraph, further comprising monitoring at least one NOx value for the flame; and adjusting a flowrate of the flue gas based on the at least one NOx value.

An embodiment of the invention is one, any or all of prior embodiments in this paragraph up through the fourth embodiment in this paragraph, wherein the first conduit comprises a plurality of further secondary tips and wherein the second conduit comprises a plurality of further primary tips, wherein the valve is a three-way control valve configured to control a proportion of fuel gas flow in the primary conduit and a proportion of fuel gas flow in the secondary conduit, and a further three-way control valve is configured to control a proportion of fuel gas flow in the plurality of further secondary tips and the plurality of further primary tips. An embodiment of the invention is one, any or all of prior embodiments in this paragraph up through the fourth embodiment in this paragraph, wherein the valve is a control valve configured to control a proportion of fuel gas flow in the primary conduit and a proportion of fuel gas flow in the secondary conduit, and a further control valve is configured to control a proportion of fuel gas flow in the plurality of further secondary tips and the plurality of further primary tips; and wherein a main valve in communication with a mixed gas source is provided and controls a proportion of mixed gas to the control valve and the further control valve. An embodiment of the invention is one, any or all of prior embodiments in this paragraph up through the fourth embodiment in this paragraph, wherein the second portion of fuel gas comprises a NOx reducing medium.

A fifth embodiment of the invention is a burner comprising a plenum; a burner tile configured to provide combustion air from the plenum through the burner tile to a combustion zone, the burner tile having an upstream portion, a throat, and a downstream portion, the downstream portion having a wall and a plurality of cavities disposed on the wall; and at least one primary conduit having a plurality of primary tips configured to inject a fuel stream comprising fuel gas into the combustion zone, wherein each of the primary tips comprising a plurality of ports. An embodiment of the invention is one, any or all of prior embodiments in this paragraph up through the fifth embodiment in this paragraph, further comprising at least one secondary conduit having a plurality of secondary tips configured to inject a second portion of a second fuel stream downstream of the primary tips. An embodiment of the invention is one, any or all of prior embodiments in this paragraph up through the fifth embodiment in this paragraph, wherein the secondary tips are disposed radially outward with respect to the primary tips and wherein the secondary tips are disposed along an outer wall of the burner tile. An embodiment of the invention is one, any or all of prior embodiments in this paragraph up through the fifth embodiment in this paragraph, wherein each secondary tip comprises a lateral port and an end port, wherein the lateral port of each secondary tip is disposed on a side of the secondary tip and is angled toward an outer wall of the burner tile, and wherein the end port of each secondary tip is disposed at a distal end of the secondary tip and is angled toward the outer wall of the burner tile. An embodiment of the invention is one, any or all of prior embodiments in this paragraph up through the fifth embodiment in this paragraph, wherein the at least one primary conduit comprises a plurality of further secondary tips and wherein the at least one secondary conduit comprises a plurality of further primary tips. An embodiment of the invention is one, any or all of prior embodiments in this paragraph up through the fifth embodiment in this paragraph, wherein the wall of the burner tile is an inner wall that comprises a curved shoulder and a planar portion, and wherein each of the plurality of cavities is disposed on the planar portion. An embodiment of the invention is one, any or all of prior embodiments in this paragraph up through the fifth embodiment in this paragraph, wherein each primary tip comprises a lateral port and an end port, wherein the lateral port is disposed on a side of the primary tip and is angled toward the inner wall of the burner tile. An embodiment of the invention is one, any or all of prior embodiments in this paragraph up through the fifth embodiment in this paragraph, wherein each end port is disposed at a distal end of the primary tip and is angled toward the wall of the burner tile. An embodiment of the invention is one, any or all of prior embodiments in this paragraph up through the fifth embodiment in this paragraph, wherein the burner tile has an annular cross section and each of the plurality of cavities is defined by a curved cross section. An embodiment of the invention is one, any or all of prior embodiments in this paragraph up through the fifth embodiment in this paragraph, wherein each of the plurality of cavities has a different diameter and is disposed at a different distance relative to the throat of the burner tile.

A sixth embodiment of the invention is a burner comprising a plenum; a burner tile arranged such that combustion air from the plenum flows from the plenum through the burner tile to a combustion zone, the burner tile having an upstream portion, a throat, and a downstream portion, the downstream portion having wall, and the burner tile further comprising a plurality of cavities disposed on the wall; at least one primary conduit having a plurality of primary tips configured to inject a first fuel stream comprising fuel gas into the combustion zone; at least one secondary conduit having a plurality of secondary tips configured to inject a second fuel stream; at least one sensor configured to sense one or more aspects of the combustion zone; a valve in fluid communication with the primary conduit and the secondary conduit; and a controller that receives inputs from the at least one sensor, wherein the controller is configured to operate the valve to control the one or more aspects of the combustion zone. An embodiment of the invention is one, any or all of prior embodiments in this paragraph up through the sixth embodiment in this paragraph, wherein the second fuel stream is injected downstream relative to the first fuel stream. An embodiment of the invention is one, any or all of prior embodiments in this paragraph up through the sixth embodiment in this paragraph, wherein the wall of the burner tile is an inner wall. An embodiment of the invention is one, any or all of prior embodiments in this paragraph up through the sixth embodiment in this paragraph, wherein the at least one sensor is one of a camera, a pressure sensor, a thermocouple, a flame detector, a calorimeter, or a chromatograph. An embodiment of the invention is one, any or all of prior embodiments in this paragraph up through the sixth embodiment in this paragraph, wherein the valve is a three-way control valve configured to control a proportion of first fuel stream flow in the at least one primary conduit and a proportion of second fuel stream flow in the at least one secondary conduit. An embodiment of the invention is one, any or all of prior embodiments in this paragraph up through the sixth embodiment in this paragraph, wherein the at least one primary conduit comprises a plurality of further secondary tips and wherein the at least one secondary conduit comprises a plurality of further primary tips. An embodiment of the invention is one, any or all of prior embodiments in this paragraph up through the sixth embodiment in this paragraph, wherein the valve is a three-way control valve configured to control a proportion of the first fuel stream flow in the at least one conduit and a proportion of the second fuel stream flow in the at least one secondary conduit, and further comprising a further control valve configured to control a proportion of the first fuel stream flow in the plurality of further secondary tips and a proportion of the second fuel stream flow in the plurality of further primary tips. An embodiment of the invention is one, any or all of prior embodiments in this paragraph up through the sixth embodiment in this paragraph, wherein the burner tile has an annular cross section and each of the plurality of cavities is defined by a curved wall.

A seventh embodiment of the invention is a process of operating a burner, the process comprising injecting combustion air into a combustion zone associated with a burner tile, the burner tile having an upstream portion, a throat, and a downstream portion, the downstream portion having a wall, the burner tile further comprising a plurality of cavities disposed on the wall; injecting a first portion of fuel gas through a plurality of primary tips into the combustion zone, wherein the combustion air and the first portion of fuel gas produce a flame in the combustion zone; and, injecting a second portion of fuel gas through a plurality of secondary tips. An embodiment of the invention is one, any or all of prior embodiments in this paragraph up through the seventh embodiment in this paragraph, further comprising detecting one or more aspects of the combustion zone; and controlling a proportion of the first portion of fuel gas in relation to the second portion of fuel gas using a valve in fluid communication with the primary tips and the secondary tips.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

The invention claimed is:

1. A burner comprising:

a plenum;

a burner tile configured to provide combustion air from the plenum through the burner tile to a combustion zone, the burner tile having an upstream portion, a throat, and a downstream portion, the downstream portion having a wall and a plurality of cavities disposed on the wall; and at least one primary conduit having a plurality of primary tips configured to inject a fuel stream comprising fuel gas into the combustion zone, wherein each of the primary tips comprising a plurality of ports, wherein each of the plurality of cavities has a different diameter and is disposed at a different distance relative to the throat of the burner tile.

2. The burner of claim 1, further comprising at least one secondary conduit having a plurality of secondary tips configured to inject a second portion of a second fuel stream downstream of the primary tips.

3. The burner of claim 2, wherein the secondary tips are disposed radially outward with respect to the primary tips and wherein the secondary tips are disposed along an outer wall of the burner tile.

4. The burner of claim 2, wherein each secondary tip comprises a lateral port and an end port, wherein the lateral port of each secondary tip is disposed on a side of the secondary tip and is angled toward an outer wall of the burner tile, and wherein the end port of each secondary tip is disposed at a distal end of the secondary tip and is angled toward the outer wall of the burner tile.

5. The burner of claim 4, wherein the at least one primary conduit comprises a plurality of further secondary tips and wherein the at least one secondary conduit comprises a plurality of further primary tips.

6. The burner of claim 1, wherein the wall of the burner tile is an inner wall that comprises a curved shoulder and a planar portion, and wherein each of the plurality of cavities is disposed on the planar portion.

7. The burner of claim 6, wherein each primary tip comprises a lateral port and an end port, wherein the lateral port is disposed on a side of the primary tip and is angled toward the inner wall of the burner tile.

8. The burner of claim 7, wherein each end port is disposed at a distal end of the primary tip and is angled toward the wall of the burner tile.

9. The burner of claim 1, wherein the burner tile has an annular cross section and each of the plurality of cavities is defined by a curved cross section.

10. A burner comprising:

a plenum;

a burner tile arranged such that combustion air from the plenum flows from the plenum through the burner tile to a combustion zone, the burner tile having an upstream portion, a throat, and a downstream portion, the downstream portion having wall, and the burner tile further comprising a plurality of cavities disposed on the wall;

at least one primary conduit having a plurality of primary tips configured to inject a first fuel stream comprising fuel gas into the combustion zone;

at least one secondary conduit having a plurality of secondary tips configured to inject a second fuel stream;

at least one sensor configured to sense one or more aspects of the combustion zone;

a valve in fluid communication with the primary conduit and the secondary conduit; and a controller that receives inputs from the at least one sensor, wherein the controller is configured to operate the valve to control the one or more aspects of the combustion zone, wherein the valve is a three-way control valve configured to control a proportion of first fuel stream flow in the at least one primary conduit and a proportion of second fuel stream flow in the at least one secondary conduit.

11. The burner of claim 10, wherein the second fuel stream is injected downstream relative to the first fuel stream.

12. The burner of claim 10, wherein the wall of the burner tile is an inner wall.

13. The burner of claim 10, wherein the at least one sensor is one of a camera, a pressure sensor, a thermocouple, a flame detector, a calorimeter, or a chromatograph.

14. The burner of claim 10, wherein the at least one primary conduit comprises a plurality of further primary tips and wherein the at least one secondary conduit comprises a plurality of further secondary tips.

15. The burner of claim 14, wherein the valve is a three-way control valve configured to control a proportion of the first fuel stream flow in the at least one conduit and a proportion of the second fuel stream flow in the at least one secondary conduit, and further comprising a further control valve configured to control a proportion of the first fuel stream flow in the plurality of further secondary tips and a proportion of the second fuel stream flow in the plurality of further primary tips.

16. The burner of claim 10, wherein the burner tile has an annular cross section and each of the plurality of cavities is defined by a curved wall.

17. A burner comprising:

a plenum;

a burner tile configured to provide combustion air from the plenum through the burner tile to a combustion zone, the burner tile having an upstream portion, a throat, and a downstream portion, the downstream portion having a wall and a plurality of cavities disposed on the wall; and at least one primary conduit having a plurality of primary tips configured to inject a fuel stream comprising fuel gas into the combustion zone, wherein each of the primary tips comprising a plurality of ports, wherein the wall of the burner tile is an inner wall that comprises a curved shoulder and a planar portion, and wherein each of the plurality of cavities is disposed on the planar portion, wherein each primary tip comprises a lateral port and an end port, wherein the lateral port is disposed on a side of the primary tip and is angled toward the inner wall of the burner tile.

* * * * *